US009523955B2

(12) United States Patent
Horita et al.

(10) Patent No.: US 9,523,955 B2
(45) Date of Patent: Dec. 20, 2016

(54) SHEET FEEDER AND IMAGE FORMING APPARATUS INCORPORATING THE SHEET FEEDER

(71) Applicants: Hirofumi Horita, Kanagawa (JP); Mizuna Tanaka, Osaka (JP); Toshikane Nishii, Osaka (JP); Ikuo Fujii, Hyogo (JP); Tomoya Tanaka, Kanagawa (JP)

(72) Inventors: Hirofumi Horita, Kanagawa (JP); Mizuna Tanaka, Osaka (JP); Toshikane Nishii, Osaka (JP); Ikuo Fujii, Hyogo (JP); Tomoya Tanaka, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/885,370

(22) Filed: Oct. 16, 2015

(65) Prior Publication Data

US 2016/0109841 A1 Apr. 21, 2016

(30) Foreign Application Priority Data

Oct. 16, 2014 (JP) ..... 2014-211474

(51) Int. Cl.

| | |
|---|---|
| ***G03G 15/00*** | (2006.01) |
| ***B65H 3/32*** | (2006.01) |
| ***B65H 5/06*** | (2006.01) |

(52) U.S. Cl.

CPC ..... *G03G 15/6529* (2013.01); *B65H 3/32* (2013.01); *B65H 5/06* (2013.01); *B65H 2601/521* (2013.01)

(58) Field of Classification Search

CPC ..... B65H 3/32
USPC ..... 399/388
See application file for complete search history.

(56) References Cited

U.S. PATENT DOCUMENTS

| | | | | |
|---|---|---|---|---|
| 3,330,179 | A * | 7/1967 | Zerfahs | G03G 15/10 399/118 |
| 5,528,352 | A * | 6/1996 | Ichinokawa | B65H 3/5223 271/121 |
| 6,540,221 | B2 * | 4/2003 | Nakashima | B65H 3/5223 271/121 |
| 6,565,079 | B1 * | 5/2003 | Kakegawa | B65H 3/5261 271/121 |

(Continued)

FOREIGN PATENT DOCUMENTS

| | | |
|---|---|---|
| JP | 7-133033 | 5/1995 |
| JP | 9-249321 | 9/1997 |

(Continued)

*Primary Examiner* — Anthony Nguyen
(74) *Attorney, Agent, or Firm* — Harness, Dickey & Pierce, P.L.C.

(57) ABSTRACT

A sheet feeder of a friction pad separation type, which can be included in an image forming apparatus, includes a feeder body, a rotary feed body, a separation body, a holder, and a leaf spring. The rotary feed body is disposed in the feeder body and feeds a recording medium along a sheet conveying direction. The separation body is fixed to the feeder body while facing the rotary feed body. The separation body separates the recording medium with the rotary feed body. The holder has a rotary shaft and holds the separation body while being rotatably supported by the rotary shaft. The leaf spring has a flexible deforming part that contacts an area adjacent to the rotary shaft and a line of action of a pressing force of the flexible deforming part passing close by the rotary shaft.

20 Claims, 17 Drawing Sheets

(56) References Cited

U.S. PATENT DOCUMENTS

| | | | | |
|---|---|---|---|---|
| 7,731,177 | B2 * | 6/2010 | Ikeda | B65H 3/0661 271/121 |
| 8,515,311 | B2 * | 8/2013 | Kishi | G03G 15/161 399/121 |
| 8,678,377 | B2 * | 3/2014 | Kurokawa | B65H 3/0684 271/121 |
| 2001/0033760 | A1 * | 10/2001 | Sawanaka | G03G 15/6558 399/316 |
| 2006/0082043 | A1 * | 4/2006 | Ikeda | B65H 3/0661 271/121 |
| 2007/0235919 | A1 * | 10/2007 | Kawamura | B65H 3/0684 271/124 |
| 2009/0121418 | A1 | 5/2009 | Tanaka et al. | |
| 2009/0174135 | A1 | 7/2009 | Tanaka et al. | |
| 2009/0238585 | A1 | 9/2009 | Hayashi et al. | |
| 2009/0302521 | A1 | 12/2009 | Kondo et al. | |
| 2009/0315250 | A1 | 12/2009 | Kimura et al. | |
| 2010/0019440 | A1 | 1/2010 | Fujiwara et al. | |
| 2010/0314827 | A1 | 12/2010 | Nishii et al. | |
| 2011/0058873 | A1 | 3/2011 | Honda et al. | |
| 2012/0061907 | A1 | 3/2012 | Matsuyama et al. | |
| 2012/0063829 | A1 | 3/2012 | Matsuyama et al. | |
| 2012/0146281 | A1 | 6/2012 | Nishii et al. | |
| 2013/0043647 | A1 | 2/2013 | Fujii et al. | |
| 2013/0164066 | A1 | 6/2013 | Nakamura et al. | |
| 2013/0200562 | A1 | 8/2013 | Matsuyama et al. | |
| 2013/0228962 | A1 | 9/2013 | Kimura et al. | |
| 2014/0049000 | A1 * | 2/2014 | Kimura | B65H 3/5223 271/3.14 |
| 2014/0077444 | A1 | 3/2014 | Fujii et al. | |
| 2015/0014919 | A1 | 1/2015 | Nakamura et al. | |

FOREIGN PATENT DOCUMENTS

| | | |
|---|---|---|
| JP | 2007-076899 | 3/2007 |
| JP | 2012-062196 | 3/2012 |
| JP | 2014-037299 | 2/2014 |

* cited by examiner

SHEET FEEDER AND IMAGE FORMING APPARATUS INCORPORATING THE SHEET FEEDER

CROSS-REFERENCE TO RELATED APPLICATIONS

This patent application is based on and claims priority pursuant to 35 U.S.C. §119(a) to Japanese Patent Application No. 2014-211474, filed on Oct. 16, 2014, in the Japan Patent Office, the entire disclosure of which is hereby incorporated by reference herein.

BACKGROUND

1. Technical Field

This disclosure relates to a sheet feeder using a friction pad for separating sheet P, and an image forming apparatus incorporating the sheet feeder.

2. Related Art

Known sheet feeders generally performs sheet separation using a pad, which is called a separation pad or a friction pad.

For sheet separation using a pad, a sheet feeder includes a sheet feed roller disposed in contact with a friction panel, i.e., a friction pad. The friction pad has a friction coefficient greater than a friction coefficient between sheet P, such that the sheet P are separated one by one in a separation nip region to feed the separated sheet in a downstream direction.

SUMMARY

At least one aspect of this disclosure provides a sheet feeder of a friction pad separation type including a feeder body, a rotary feed body, a separation body, a holder, and a leaf spring. The rotary feed body is disposed in contact with a first side of a recording medium in the feeder body and rotates and feeds the recording medium to a downstream side along a sheet conveying direction. The separation body is disposed in contact with a second side of the recording medium and fixed to the feeder body while facing the rotary feed body. The separation body separates the recording medium with the rotary feed body. The holder has a rotary shaft at an end thereof and holds the separation body while being rotatably supported by the rotary shaft. The leaf spring is attached to the feeder body and has a flexible deforming part formed on one end thereof. The flexible deforming part contacts an area adjacent to the rotary shaft in an axial direction of the rotary shaft and a line of action of a pressing force of the flexible deforming part passing close by the rotary shaft.

Further, at least one aspect of this disclosure provides an image forming apparatus including an image bearer, a charger, an exposure device, a developing device, a transfer device, and the above-described sheet feeder. The image bearer forms an electrostatic latent image on a surface thereof. The charger uniformly charges the surface of the image bearer. The exposure device optically writes the electrostatic latent image on the surface of the image bearer according to image data. The developing device provided with a developer bearer to bear developer including toner thereon and developing the electrostatic latent image formed on the surface of the image bearer into a visible image by supplying the developer borne on the developer bearer. The transfer device transfers the visible toner image developed by the developing device onto the recording medium. The above-described sheet feeder feeds the recording medium to the transfer device.

DETAILED DESCRIPTION

Figure 1:
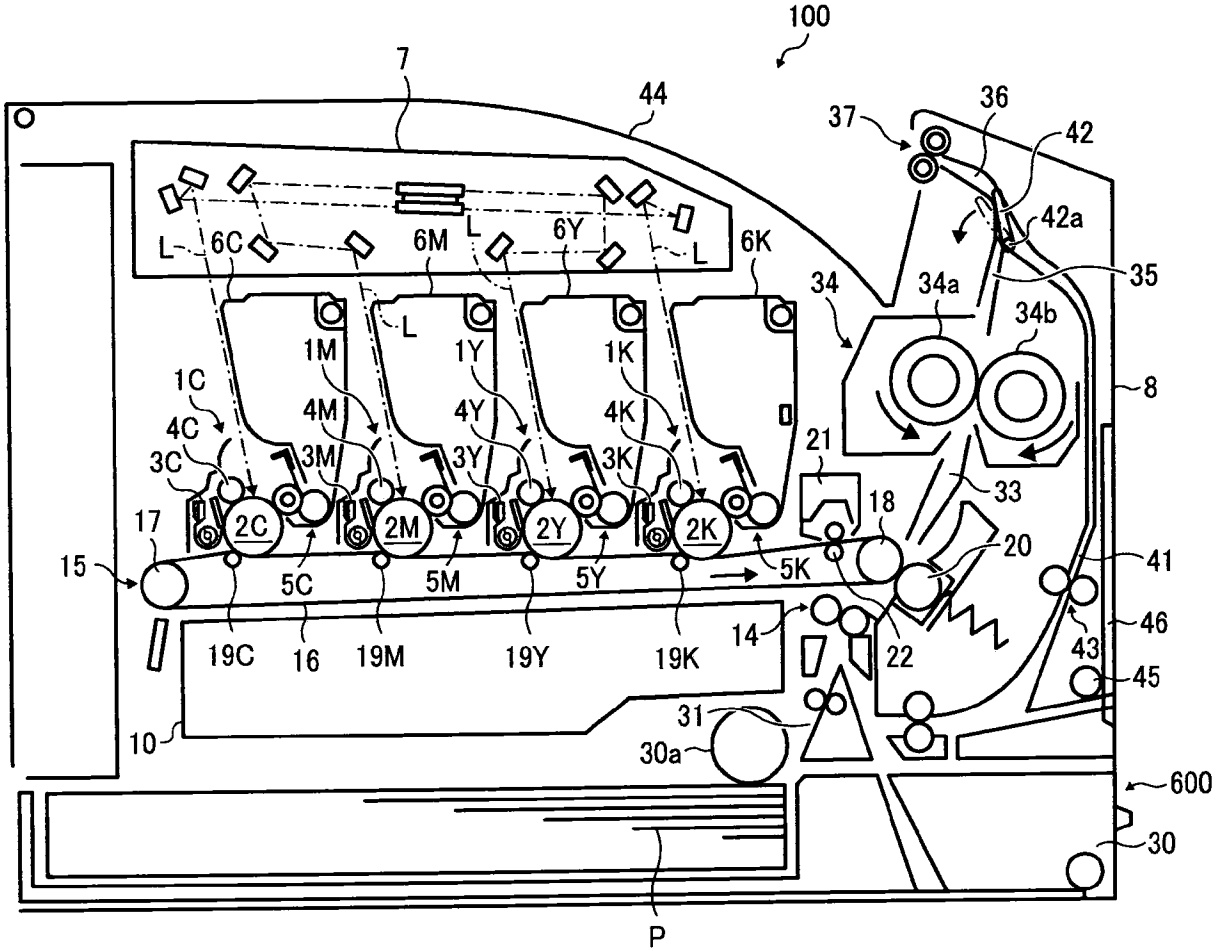
FIG. 1 is a cross sectional view illustrating an image forming apparatus according to an example of this disclosure incorporating an sheet feeder according to an example of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Now, descriptions are given of an example applicable to a sheet feeder and an image forming apparatus incorporating the sheet feeder with reference to the following figures.

It is to be noted that identical parts are given identical reference numerals and redundant descriptions are summarized or omitted accordingly.

It is to be noted in the following examples that: the term "image forming apparatus" indicates an apparatus in which an image is formed on a recording medium such as paper, OHP (overhead projector) transparencies, OHP film sheet P, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Configuration of Image Forming Apparatus. A sheet feeder 600 according to this disclosure is applicable to be employed to an image forming apparatus 100 or an image reading device.

FIG. 1 illustrates a schematic configuration of an image forming apparatus 100 according to an example of this disclosure.

The image forming apparatus 100 may be a copier, a printer, a scanner, a facsimile machine, a plotter, and a multifunction peripheral or a multifunction printer (MFP) having at least one of copying, printing, scanning, facsimile, and plotter functions, or the like. According to the present example, the image forming apparatus 100 is an electrophotographic printer that forms toner images on a sheet or sheets by electrophotography.

More specifically, the image forming apparatus 100 functions as a printer. However, the image forming apparatus 100 can expand its function as a copier by adding a scanner as an option disposed on top of an apparatus body of the image forming apparatus 100. The image forming apparatus 100 can further obtain functions as a facsimile machine by adding an optional facsimile substrate in the apparatus body of the image forming apparatus 100.

Further, this disclosure is also applicable to image forming apparatuses adapted to form images through other schemes, such as known ink jet schemes, known toner projection schemes, or the like as well as to image forming apparatuses adapted to form images through electro-photographic schemes.

As illustrated in FIG. 1, the image forming apparatus 100 includes four process units 1K, 1Y, 1M, and 1C.

Suffixes, which are K, Y, M, and C, are used to indicate respective colors of toners (e.g., black, yellow, magenta, and cyan toners) for the process units 1K, 1Y, 1M, and 1C. The process units 1K, 1Y, 1M, and 1C have substantially the same configuration except for containing different color toners of black (K), yellow (Y), magenta (M), and cyan (C) corresponding to color separation components of a color image.

The process units 1K, 1Y, 1M, and 1C have the same structure, differing in the colors of toners in toner bottles 6K, 6Y, 6M, and 6C, respectively. Therefore, these components and units having an identical configuration but a different color are hereinafter occasionally referred to in a singular form without suffixes occasionally, for example, as the process unit 1.

The process unit 1 (i.e. the process units 1K, 1Y, 1M, and 1C) further includes a photoconductor drum 2 (i.e., photoconductor drums 2K, 2Y, 2M, and 2C) functioning as an image bearer, a drum cleaning unit 3 (i.e., drum cleaning units 3K, 3Y, 3M, and 3C), an electricity discharging unit, a charging unit 4 (i.e., charging units 4K, 4Y, 4M, and 4C) functioning as a charger, and a developing unit 5 (i.e., developing units 5K, 5Y, 5M, and 5C), respectively. The process units 1K, 1Y, 1M, and 1C are detachably attachable to an apparatus body of the image forming apparatus 100, and consumable parts can be replaced at one time.

The charging unit 4 uniformly changes a surface of the photoconductor drum 2.

The developing unit 5 develops an electrostatic latent image formed on the charged surface of the photoconductor drum 2 into a visible toner image by applying toner.

The image forming apparatus 100 further includes an optical writing device 7 disposed above the process units 1K, 1Y, 1M, and 1C. The optical writing device 7 scans and writes an electrostatic latent image on the surface of the photoconductor drum 2. Specifically, the optical writing device 7 emits light based on image data from a laser diode to form the electrostatic latent image on the surface of the photoconductor drum 2.

A transfer device 15 is disposed below the process units 1Y, 1C, 1M, and 1K in the configuration illustrated in FIG. 1. The transfer device 15 includes four primary transfer rollers 19K, 19Y, 19M, and 19C, an intermediate transfer belt 16, a secondary transfer roller 20, a belt cleaning unit 21, and a cleaning backup roller 22.

The primary transfer rollers 19K, 19Y, 19M, and 19C are disposed facing the photoconductor drums 2K, 2Y, 2M, and 2C, respectively, with the intermediate transfer belt 16 interposed therebetween.

The intermediate transfer belt 16 is an endless belt that is entrained around the primary transfer rollers 19K, 19Y, 19M, and 19C, a driving roller 18, and a driven roller 17 to rotate therearound.

The secondary transfer roller 20 that functions as a secondary transfer unit is disposed facing the driving roller 18 to form a secondary transfer nip region therebetween and in contact with the intermediate transfer belt 16.

The photoconductor drums 2K, 2Y, 2M, and 2C are defined as first image bearers, and the intermediate transfer belt 16 may be a second image bearer that carries a composite image thereon.

The belt cleaning unit 21 is disposed downstream from the secondary transfer roller 20 in a direction of rotation of the intermediate transfer belt 16.

The cleaning backup roller 22 is disposed opposite to the belt cleaning unit 21 with the intermediate transfer belt 16 interposed therebetween.

The image forming apparatus 100 further includes a sheet tray 30 that functions as a feeder body to accommodate multiple sheet P therein as a bundle of sheets P and a sheet feed roller 30*a* that functions as a sheet feeding body.

The sheet tray 30 is disposed at a lower part of the image forming apparatus 100 and is detachably attachable to the apparatus body of the image forming apparatus 100 for sheet P, for example.

The sheet feed roller 30*a* is disposed above the sheet tray 30 in a state in which the sheet tray 30 is set in the apparatus body of the image forming apparatus 100, as illustrated in FIG. 1. A sheet P is fed from the sheet tray 30 toward a sheet feeding path 31. The sheet tray 30 and the sheet feed roller 30*a* form a sheet feeder 600 according to an example of this disclosure.

A timing roller pair 14 is disposed immediately upstream from the secondary transfer roller 20 in a sheet conveying direction in order to stop the sheet P fed from the sheet tray 30 thereat temporarily. By stopping the sheet P temporarily at the timing roller pair 14, the sheet P is sagged at the leading end thereof.

The sagged sheet P is further sent to the secondary transfer nip region formed between the secondary transfer roller 20 and the driving roller 18 so as to synchronize with a toner image formed on the intermediate transfer belt 16 at a given timing at which the toner image is transferred reliably. The toner image that is formed on the intermediate transfer belt 16 temporarily stopped at the secondary transfer nip region is transferred onto the sheet P at a desired transfer position thereof with high accuracy.

The image forming apparatus 100 further includes a post-transfer sheet conveying path 33, a fixing device 34, a post-fixing sheet conveying path 35, a sheet discharging path 36, a sheet discharging roller pair 37, a switchback conveying path 41, a switching member 42, a switchback conveying roller pair 43, and a sheet discharging tray 44.

The post-transfer sheet conveying path 33 is defined above the secondary transfer nip region formed between the secondary transfer roller 20 and the driving roller 18.

The fixing device 34 is disposed in a vicinity of a downstream end of the post-transfer sheet conveying path 33.

The fixing device 34 includes a fixing roller 34*a* and a pressure roller 34*b*. The fixing roller 34*a* includes a heat generating source such as a halogen lamp. The pressure roller 34*b* is pressed against the fixing roller 34*a*. The fixing roller 34*a* and the pressure roller 34*b* contacting each other form a fixing nip region.

The post-fixing sheet conveying path 35 is disposed above the fixing device 34. The post-fixing sheet conveying path 35 branches at a downstream end thereof at its highest position into two paths, which are the sheet discharging path 36 and the switchback conveying path 41.

The switching member 42 is disposed at the downstream end of the post-fixing sheet conveying path 35. The switching member 42 rotates about a swing shaft 42*a* for switching the sheet conveying direction of the sheet P.

The sheet discharging roller pair 37 is disposed at a downstream end of an opening of the sheet discharging path 36.

The switchback conveying path 41 meets the sheet feeding path 31 at a downstream end thereof, which is an opposite end where the post-fixing sheet conveying path 35 branches into the sheet discharging path 36 and the switchback conveying path 41.

The switchback conveying roller pair 43 is disposed in the middle of the switchback conveying path 41.

The sheet discharging tray 44 is formed on top of the apparatus body of the image forming apparatus 100. The sheet discharging tray 44 includes a top cover recessed inwardly.

The image forming apparatus 100 further includes a powder container 10.

The powder container 10 (e.g., a toner container) is disposed between the transfer device 15 and the sheet tray 30 to contain waste toner therein. The powder container 10 is detachably attachable to the apparatus body of the image forming apparatus 100.

The image forming apparatus 100 according to the present example is designed that the sheet feed roller 30*a* is separated from the secondary transfer roller 20 by a certain distance or gap due to conveyance of a sheet P such as the sheet P. This separation generates dead space or unused space. By disposing the powder container 10 in the dead space, a reduction in overall size of the image forming apparatus 100 is achieved.

A transfer cover 8 is disposed above and in front of the sheet tray 30 in a tray removing direction. By opening the transfer cover 8, an inside of the image forming apparatus 100 can be inspected. The transfer cover 8 is provided with a bypass tray 46 from which the sheet P can be fed and a bypass feed roller 45 by which the sheet P is fed from the bypass tray 46.

As described above, even though the image forming apparatus 100 according to the present example of this disclosure has a configuration of a laser printer, the configuration and functions of the image forming apparatus 100 are not limited to a printer. Specifically, the image forming apparatus 100 is applicable to any of a copier, facsimile machine, printer, printing machine, ink jet recording device, and a multi-functional apparatus including at least two functions of the copier, facsimile machine, printer, printing machine, and ink jet recording device.

Basic image forming operation of the image forming apparatus 100.

Next, a description is given of basic image forming operations of the image forming apparatus 100 according to an example of this disclosure with reference to FIG. 1.

First, a series of basic operations of a simplex or single-sided printing is described.

A controller is provided to the image forming apparatus 100 illustrated in FIG. 1 issues sheet feeding signals. In response to the sheet feeding signals, the controller causes the sheet feed roller 30*a* to rotate. As the sheet feed roller 30*a* starts to rotate, an uppermost sheet P that is placed on top of the bundle of sheets P in the sheet tray 30 is separated from the other sheet P accommodated in the sheet tray 30 to be fed toward the sheet feeding path 31.

When the leading edge of the sheet P reaches the secondary transfer nip region of the timing roller pair 14, the sheet P stands by while being sagged so that skew at the leading edge of the sheet P is calibrated and that movement of the sheet P is synchronized with movement of a toner image formed on the intermediate transfer belt 16.

When feeding the sheet P from the bypass tray 46, the sheet P placed on top of the bundle of sheets P loaded on the bypass tray 46 is fed one by one by the bypass feed roller 45. The sheet P fed from the bypass tray 46 is forwarded by the bypass feed roller 45 to travel part of the switchback conveying path 41 to the secondary transfer nip region of the timing roller pair 14. The subsequent operations using the bypass tray 46 are the same operations in sheet feeding from the sheet tray 30, and therefore are omitted.

Here, the components and units having an identical configuration but a different color of the process units 1K, 1Y, 1M, and 1C are hereinafter referred to in a singular form without suffixes occasionally, for example, as the process unit 1.

In the basic image forming operations of the process unit 1, the charging unit 4 uniformly charges a surface of the photoconductor drum 2 by supplying a high electric potential at the surface of the photoconductor drum 2.

Based on image data, a laser light beam L is emitted from the optical writing device 7 to the charged surface of the photoconductor drum 2, so that the electric potential at the emitted portion on the surface of the photoconductor drum 2 decreases to form an electrostatic latent image.

The toner bottle 6 supplies the unused color toner to the developing unit 5. The developing unit 5 then supplies the respective color toner to the electrostatic latent image formed on the surface of the photoconductor drum 2 to develop the electrostatic latent image into a visible toner image. Then, the toner image formed on the surface of the photoconductor drum 2 is transferred onto a surface of the intermediate transfer belt 16.

The drum cleaning unit 3 removes residual toner remaining on the surface of the photoconductor drum 2 after an intermediate transfer operation. The removed residual toner is conveyed by a waste toner conveyance unit and collected to a waste toner collecting unit included in the process unit 1. The electricity discharging unit removes residual electric potential remaining on the surface of the photoconductor drum 2 after cleaning by the drum cleaning unit 3.

As previously described, the above description details operations are performed in each of the process units 1K, 1Y, 1M, and 1C. For example, respective toner images are developed on the respective surfaces of the photoconductor drums 2K, 2Y, 2M, and 2C and are then sequentially transferred onto the surface of the intermediate transfer belt 16 to form a composite color image.

After the respective color toner images are transferred sequentially onto the surface of the intermediate transfer belt 16 to form a composite toner image, the intermediate transfer belt 16 moves to the secondary transfer nip region formed between the secondary transfer roller 20 and the driving roller 18, where the toner image formed on the intermediate transfer belt 16 is transferred onto the sheet P conveyed by the timing roller pair 14.

Specifically, the sheet P is fed to the secondary transfer nip region at an optimal timing in synchronization with movement of the composite toner image formed by sequentially overlaying the respective color toner images and transferred onto the surface of the intermediate transfer belt 16. Then, the composite toner image formed on the surface of the intermediate transfer belt 16 is transferred onto the sheet P conveyed as above at a desired position in the secondary transfer nip region formed between the driving roller 18 and the secondary transfer roller 20 with the intermediate transfer belt 16 interposed therebetween with high accuracy.

The sheet P on which the transferred toner image is formed passes through the post-transfer sheet conveying path 33 to the fixing device 34. In the fixing device 34, the sheet P passes between the fixing roller 34*a* and the pressure roller 34*b*. Thus, the unfixed toner image on the sheet P is fixed to the sheet P by application of heat and pressure. The sheet P with the fixed image thereon is conveyed from the fixing device 34 to the post-fixing sheet conveying path 35.

At the feeding of the sheet P from the fixing device 34, the switching member 42 is at a position as illustrated by a solid line in FIG. 1 to allow passage of the sheet P around an open space at the end of the post-fixing sheet conveying path 35. After traveling from the fixing device 34 through the post-fixing sheet conveying path 35, the sheet P is held by and passes through the sheet discharging roller pair 37, and is discharged to the sheet discharging path 36. As described above, the sheet discharging roller pair 37 holds the sheet P fed to the sheet discharging path 36 and rotates to convey the sheet P to the sheet discharging tray 44. By performing this operation, a series of the simplex printing operations is completed.

Next, a series of basic operations of a duplex or double-sided printing is described.

Similar to the operations of a simplex printing, the sheet P having a fixed image on one side thereof is conveyed from the fixing device 34 to the sheet discharging path 36.

When performing duplex printing, the sheet discharging roller pair 37 rotates to convey the sheet P so that part of the sheet P is exposed to an outside of the image forming apparatus 100.

As the trailing end of the sheet P passes through the sheet discharging path 36, the switching member 42 rotates about the swing shaft 42*a* to a position indicated by a dotted line in FIG. 1 to block the passage of the sheet P at the end of the post-fixing sheet conveying path 35. Substantially simultaneously, the sheet discharging roller pair 37 rotates in reverse to feed the sheet P in an opposite direction to the switchback conveying path 41.

The sheet P conveyed in the switchback conveying path 41 passes through the switchback conveying roller pair 43 and reaches the timing roller pair 14. The timing roller pair 14 measures optimal timing to transfer a toner image formed on the intermediate transfer belt 16 onto an unprinted side, i.e., a reverse side of the sheet P in synchronization with movement of the toner image formed on the surface of the intermediate transfer belt 16 and conveys the sheet P to the secondary transfer nip region.

When the sheet P passes through the secondary transfer nip region formed between the driving roller 18 and the secondary transfer roller 20 with the intermediate transfer belt 16 interposed therebetween, the toner image is transferred onto on the reverse side of the sheet P on which no image has not yet formed. The sheet P having the toner image formed on the reverse side thereof is then conveyed to the fixing device 34 via the post-transfer sheet conveying path 33.

In the fixing device 34, the sheet P is held between the fixing roller 34*a* and the pressure roller 34*b* to fix the unfixed toner image formed on the unused reverse side of the sheet P to the sheet P by application of heat and pressure. The sheet P with the fixed toner image thereon is conveyed from the fixing device 34 to the post-fixing sheet conveying path 35.

At the feeding of the sheet P from the fixing device 34, the switching member 42 is at the position as illustrated by a solid line in FIG. 1 to allow passage of the sheet P around an open space at an upper end of the post-fixing sheet conveying path 35. After traveling from the fixing device 34, the sheet P is conveyed to the sheet discharging path 36 via the post-fixing sheet conveying path 35. The sheet discharging roller pair 37 holds the sheet P in the sheet discharging path 36 and rotates to convey the sheet P to discharge to the sheet discharging tray 44. By performing this operation, a series of the duplex printing operations is completed.

Even after the toner image formed on the surface of the intermediate transfer belt 16 is transferred onto the sheet P, residual toner remains on the surface of the intermediate transfer belt 16. The belt cleaning device 21 removes the residual toner from the intermediate transfer belt 16.

After being removed from the intermediate transfer belt 16, the residual toner is conveyed by the waste toner conveying unit and collected to the powder container 10.

Basic Configuration of Sheet Feeder Using Separation Pad Feeding System.

Figure 2A:
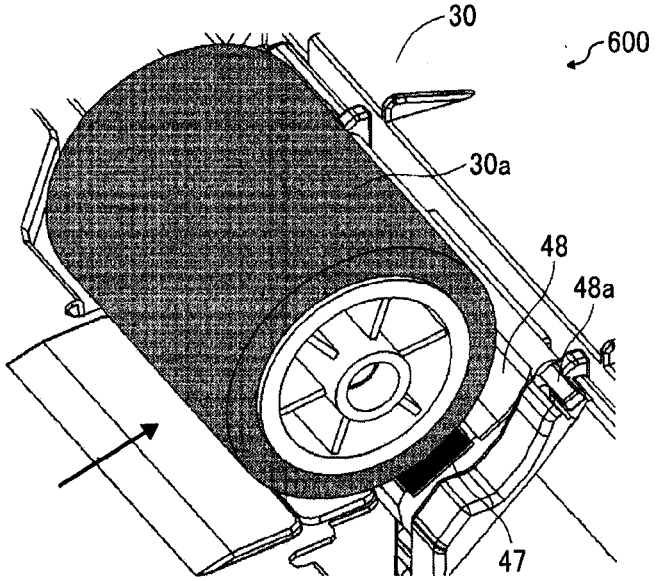
FIG. 2A is a perspective view illustrating the sheet feeder of FIG. 1 employing a sheet separating method using a separation pad.
Figure 2B:
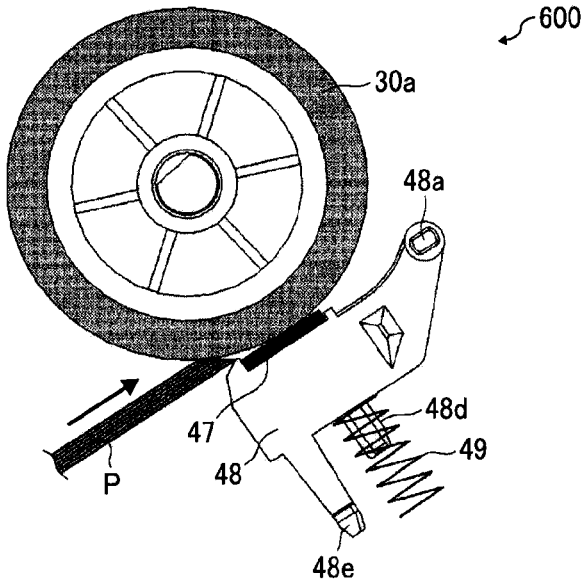
FIG. 2B is a side view illustrating the sheet feeder of FIG. 1 employing the sheet separating method using the separation pad.

Before describing the sheet feeder 600 that employs a sheet separating method using a sheet separation pad according to an example of this disclosure, a description is given of a basic configuration of the sheet separation pad, with reference to FIGS. 2A and 2B.

FIG. 2A is a perspective view illustrating the sheet feeder 600 of FIG. 1 employing a sheet separating method using a separation pad. FIG. 2B is a side view illustrating the sheet feeder 600 of FIG. 1 employing the sheet separating method using the separation pad.

The sheet feeder 600 having a general configuration as illustrated in FIGS. 2A and 2B includes a sheet separation pad holder 48, which is hereinafter referred to simply as a holder 48. The holder 48 includes a rotary shaft 48*a* that is formed in a unity structure at a downstream end in the sheet conveying direction. The holder 48 is rotatably supported by the rotary shaft 48*a*. This configuration is referred to as a downstream rotation system. The sheet feeder 600 according the present example and the other examples below of this disclosure employs the downstream rotation system. However, the rotation system of the sheet feeder 600 is not limited thereto. For example, this disclosure can be applied to the configuration of an upstream rotation system in which the rotary shaft 48*a* is formed at an upstream end in the sheet conveying direction.

An upper face of the uppermost sheet P in the bundle of sheets P loaded on the sheet tray 30 illustrated in FIG. 1 is pressed to the sheet feed roller 30*a*. Then, the upstream sheet P is conveyed one by one to the right side in FIG. 1 along with rotation of the sheet feed roller 30*a*.

As illustrated in FIG. 2B, in a multi-feed error in which multiple sheets P are conveyed together, the multi-feed sheet is held into a separation nip region formed between the sheet feed roller 30*a* and the sheet separation pad 47.

A separation spring 49 is disposed between the holder 48 and the sheet tray 30 disposed below the holder 48 and between the holder 48 and the sheet tray 30. An upper end of the separation spring 49 is retained by a spring receiving projection 48*d* of the holder 48. According to this configuration, the separation spring 49 applies a given pressing force to the separation nip region.

Consequently, when a coefficient of friction between the sheet feed roller 30*a* and the sheet P is represented as "μr", a coefficient of friction between adjacent sheets P is represented as "μp", and a coefficient of friction between the sheet P and the sheet separation pad 47 is represented as "μf", a relation of these three coefficients of friction is set to be as follows:

$$\mu r > \rho f > \mu p.$$

When the multiple sheets P are sent together to the separation nip region, a lower face of a lowermost sheet P contacts the sheet separation pad 47, and therefore is prevented from being fed together with the other sheets of the multiple sheets P. Consequently, the uppermost sheet P is separated by friction and is conveyed in the downstream direction.

The holder 48 further includes a stopper 48*e* at the lower part thereof. According to this configuration, when the sheet feed roller 30*a* is retreated in an upward direction, the stopper 48*e* engages with an engaging part of the sheet tray 30. According to this configuration, an upper position of the holder 48 is regulated.

Figure 3A:
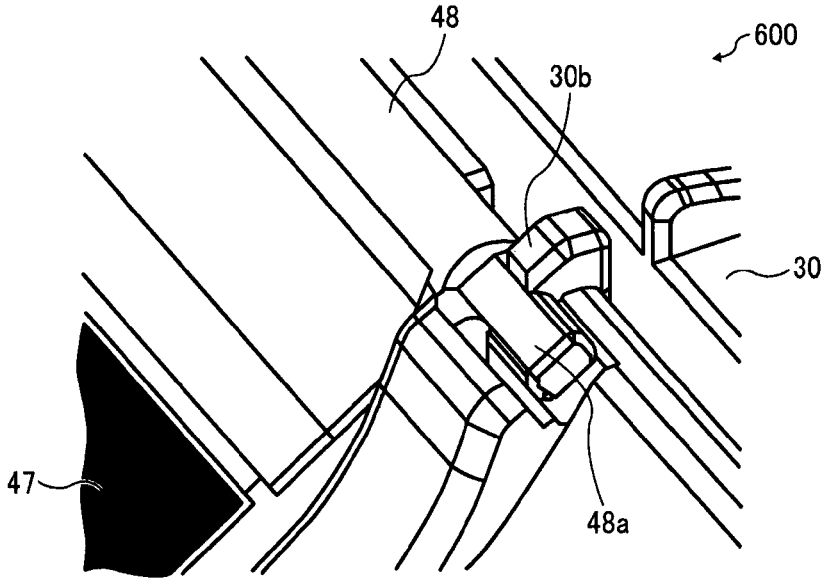
FIG. 3A is an enlarged perspective view illustrating an area close to a rotary shaft of a separation pad holder of the sheet feeder of FIG. 1.
Figure 3B:
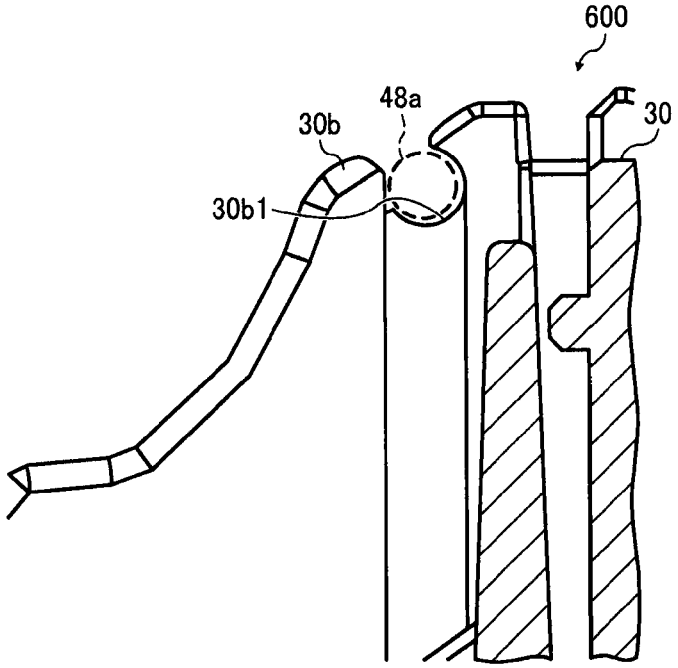
FIG. 3B is an enlarged side view illustrating the area close to the rotary shaft of the separation pad holder of the sheet feeder of FIG. 1.

FIGS. 3A and 3B are enlarged perspective views illustrating an area close to the rotary shaft 48*a* of the holder 48. The sheet tray 30 further includes retaining parts 30*b* in areas adjacent to both ends in an axial direction of the holder 48. The retaining parts 30*b* rotatably support both axial ends of the rotary shaft 48*a* of the holder 48. The retaining parts 30*b* have respective shaft holes 30*b*1 formed in an inverted ohm (Ω) shape or a downward U shape. The rotary shaft 48*a* is fitted from above with respect to the shaft holes 30*b*1 in a form of an inverted ohm shape or a downward U shape. Hereinafter, the shaft holes 30*b*1 in a form of an inverted ohm shape or a downward U shape are simply referred to as the shaft holes 30*b*1.

If the cross section of the rotary shaft 48*a* is a circular shape, the rotary shaft 48*a* can be fitted to the shaft holes 30*b*1 by snap-fit. In the present example, however, both ends of the circular cross section of the rotary shaft 48*a* are cut in a parallel plane in order to insert the rotary shaft 48*a* into the shaft holes 30*b*1 more easily. By so doing, the rotary shaft 48*a* can be inserted easily in a vertical direction into the shaft holes 30*b*1. When the sheet feeder 600 is used, by setting the rotary shaft 48*a* in a horizontal direction as illustrated FIG. 3A, the rotary shaft 48*a* is not pulled out from the shaft holes 30*b*1.

By rotatably retaining the rotary shaft 48*a* by the retaining parts 30*b*, the holder 48 can rotate about the rotary shaft 48*a*. A certain clearance (play) is provided between the rotary shaft 48*a* and each shaft hole 30*b*1 of the retaining parts 30*b* so as not to generate a load torque in the rotation direction of the holder 48.

However, this clearance can generate noise from the holder 48 easily when separating the sheet P one by one. Specifically, if there is the clearance provided between the rotary shaft 48*a* and each shaft hole 30*b*1 of the retaining parts 30*b*, the holder 48 can vibrate easily due to a frictional force generated between the sheet separation pad 47 and the sheet P in sheet separation.

Specifically, sheet separation using a friction pad can easily generate noise due to vibration caused by a slip-stick friction between the friction pad and a sheet. In order to reduce a turning torque of a pad holder of the friction pad, a certain amount of clearance is generally provided between a rotary shaft of the pad holder and a supporting part that supports the rotary shaft. If, however, the clearance is too large, the pad holder vibrates easily.

A known sheet feeder reduces the clearance of the pad holder while restraining the turning torque of the pad holder by pressing an area in the vicinity of the rotary shaft of the pad holder with an elastic member such as a leaf spring.

However, a configuration of a sheet feeder that is provided with a spring or springs is generally large and cannot contribute to a reduction in size of the sheet feeder. In addition, attachment of the spring(s) is labor- and time-consuming. Further, it is difficult to direct a line of action of a biasing force of a leaf spring to the rotary shaft correctly in the configuration having the spring(s). If the line of action of the biasing force of the leaf spring is shifted from the rotary shaft, a turning torque of the pad holder is adversely affected, and therefore separation performance is degraded.

Next, a description is given of the sheet feeder 600 including a sheet separation pad according to examples of this disclosure. The sheet feeder 600 can restrain vibration of the holder 48 due to the clearance without being affected by a turning moment of the holder 48.

Figure 4A:
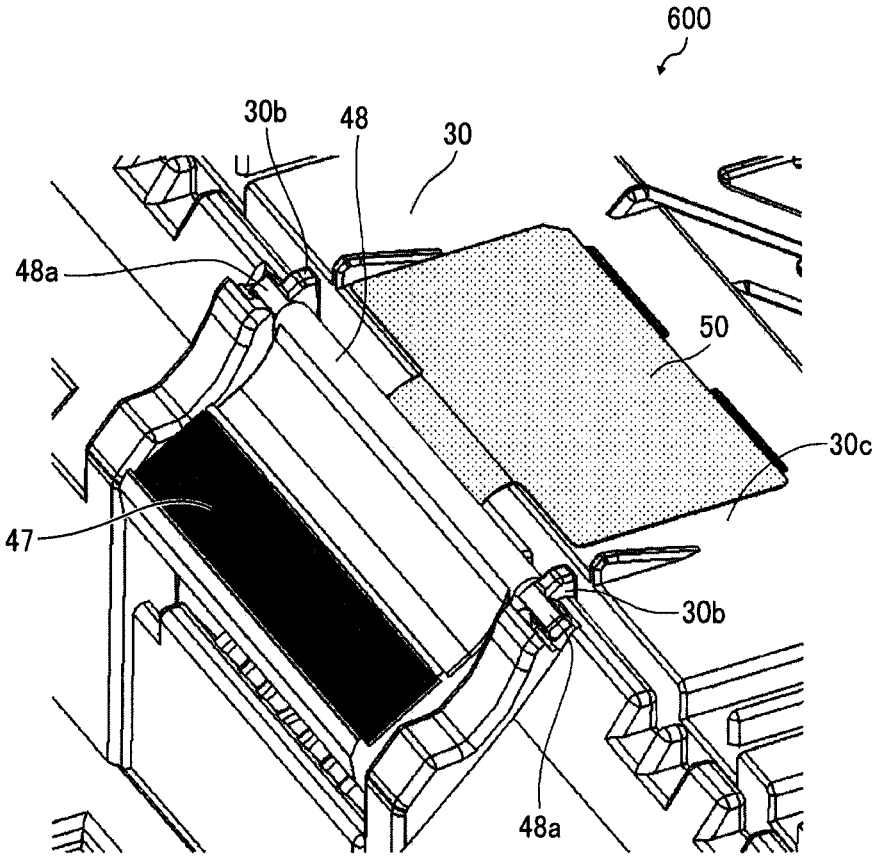
FIG. 4A is a perspective view illustrating the sheet feeder according to an example of this disclosure, from which a sheet feed roller is removed.
Figure 4B:
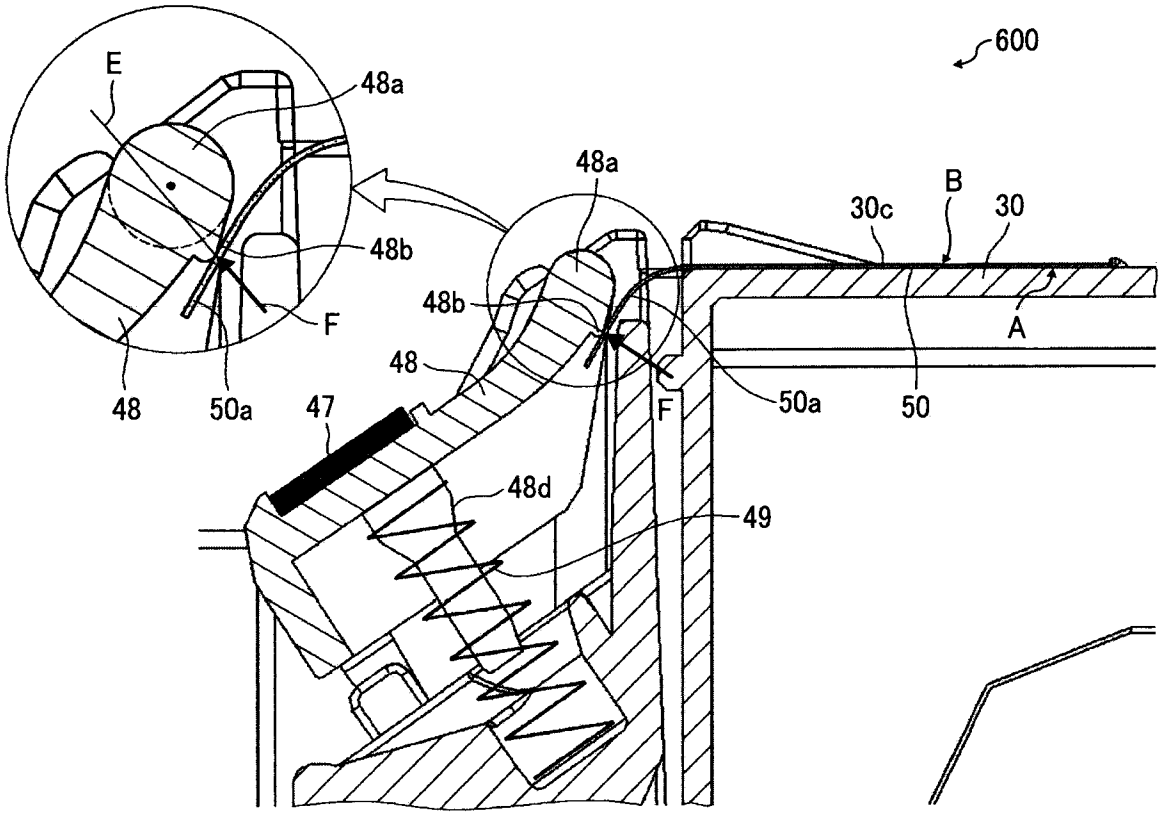
FIG. 4B is a cross sectional view illustrating the sheet feeder of FIG. 4A at the center in a width direction of the separation pad holder from which the sheet feed roller is removed.
Figure 5:
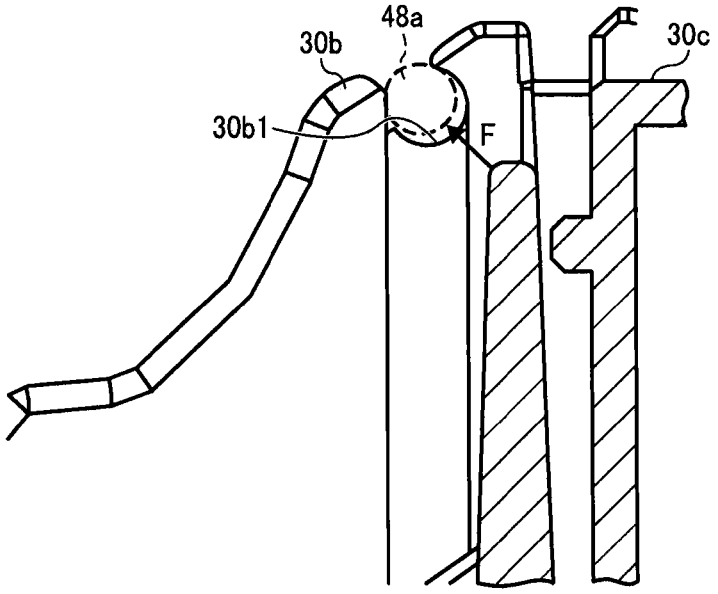
FIG. 5 is a side view illustrating the sheet feeder of FIGS. 4A and 4B in a state in which the rotary shaft of the separation pad holder is fitted into a shaft hole of a retaining part.

FIG. 4A is a perspective view illustrating the holder 48 of the sheet feeder 600 according to an example of this disclosure, in which the sheet separation pad 47 is retained. FIG. 4B is a cross sectional view illustrating the holder 48 of the sheet feeder 600, in a width direction thereof.

The basic configuration of the sheet feeder 600 illustrated in FIGS. 4A and 4B is basically identical to the configuration of the sheet feeder 600 illustrated in FIGS. 2A and 2B.

Specifically, the sheet feeder 600 includes the sheet feed roller 30*a* that functions as a rotary feed body to feed the sheet P, the sheet separation pad 47 that functions as a separation body to separate the sheet P one by one from the bundle of sheets, the holder 48 to support the sheet separation pad 47, a separation spring 49 to press the holder 48 to the sheet feed roller 30*a*. The sheet separation pad 47 and the holder 48 remain stopped at respective given positions in the sheet conveying direction of the sheet P.

In the configuration of the present example of this disclosure, the sheet feeder 600 includes a leaf spring 50 to restrain vibration of the holder 48. The leaf spring 50 is employed to the other configurations described below. The leaf spring 50 is a rectangular member, and a body of the leaf spring 50 is fixedly adhered by a double-coated adhesive tape and the like to a flat attaching part 30*c* located on an upper face of the sheet tray 30 that functions as a feeder body. The attaching part 30*c* of the sheet tray 30 is located downstream from the sheet feed roller 30*a* and the holder 48 in the sheet conveying direction.

Figure 7A:
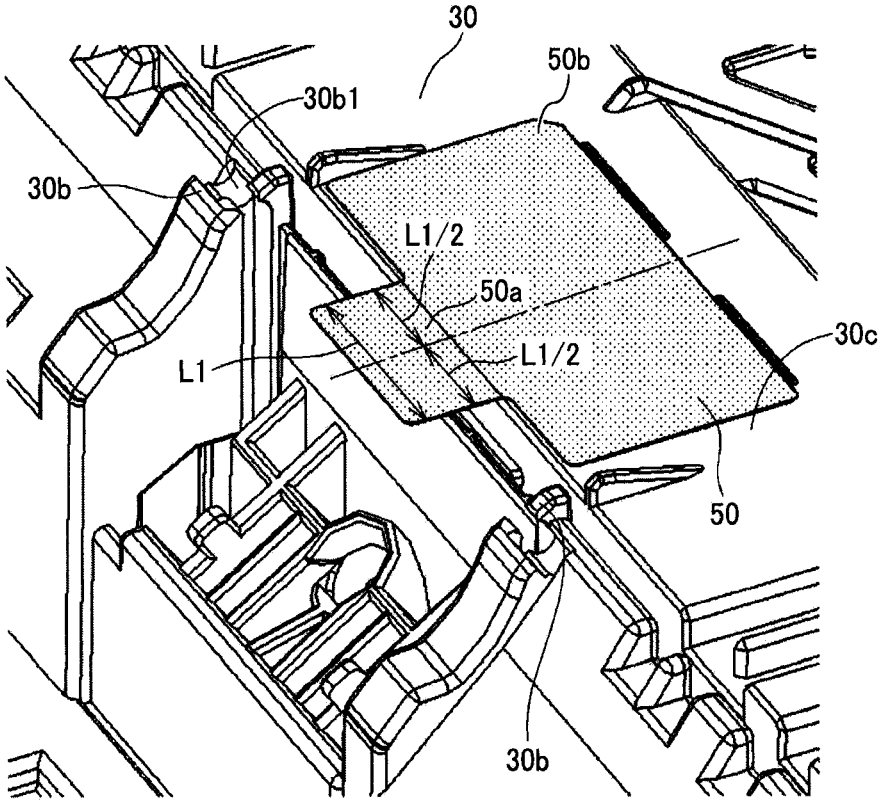
FIG. 7A is a perspective view illustrating the sheet feeder of FIGS. 4A and 4B from which the sheet feed roller and the separation pad holder are removed.

The leaf spring 50 has a body 50*b* and a flexible deforming part 50*a* that is formed at a center of a long-edge of an upstream side of the body 50*b*. As illustrated in FIG. 7A, the flexible deforming part 50*a* is a rectangle having a width L1 in a lateral direction of the sheet tray 30. In addition, as illustrated in FIG. 4B, a leading end of the flexible deforming part 50*a* is in contact with an area close to a lower part of the rotary shaft 48*a* when viewed from an axial direction of the rotary shaft 48*a* of the holder 48.

It is to be noted that a width indicated with "L1/2" in FIG. 7A is a half of the length of the width L1.

The holder 48 further includes a contact part 48*b* that is formed close to the rotary shaft 48*a*. As illustrated in FIG. 4B, the contact part 48*b* is formed in an outwardly curved shape when viewed from the axial direction of the rotary shaft 48*a* of the holder 48. The leading end of the flexible deforming part 50*a* contacts the outwardly curved contact part 48*b* of the holder 48 from below. Further, a line of action E of a pressing force F of the leading end of the flexible deforming part 50*a* is directed to pass through the center of the rotary shaft 48*a* of the holder 48 or pass close by the rotary shaft 48*a*, as illustrated in FIG. 4B.

The reason to form the contact part 48*b* in such an outwardly curved shape is to cause the leading end of the flexible deforming part 50*a* and the contact part 48*b* to be in point contact with each other, irrespective of the position of rotation of the rotary shaft 48*a*. By so doing, the position of a pressing point of the pressing force F can remain stable, and therefore vibration and abnormal sound (noise) of the holder 48 can be effectively stabilized.

With the pressing force F, the clearance formed between the rotary shaft 48*a* of the holder 48 and each shaft hole 30*b*1 of the respective retaining parts 30*b* is reduced. Accordingly, vibration of the holder 48 caused by rattling of the retaining parts 30*b* can be restrained, and therefore abnormal sound that occurs when separating the sheet P can be prevented. In addition, the leaf spring 50 is space-saving, and therefore abnormal sound can be effectively restrained without increasing the size of the sheet feeder 600.

Figure 6:
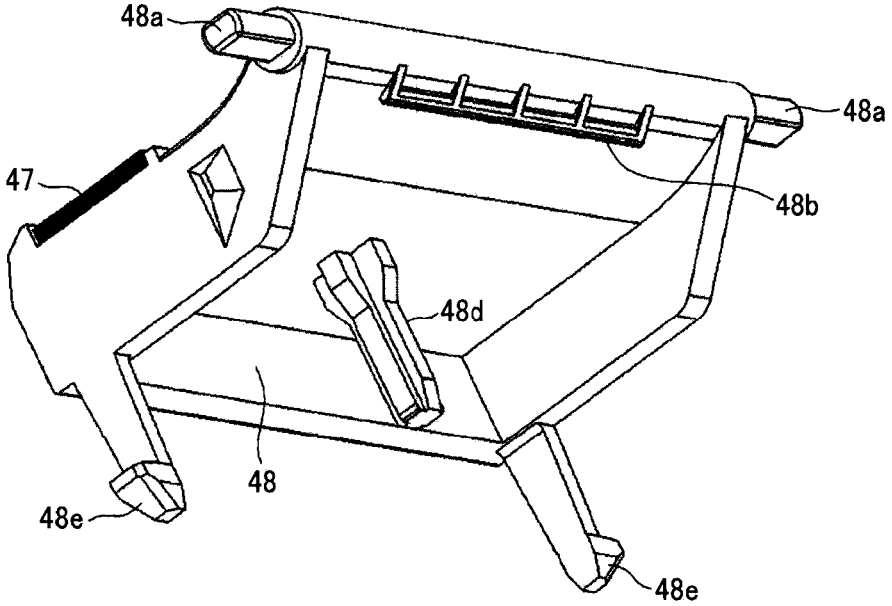
FIG. 6 is a perspective view illustrating the sheet feeder of FIGS. 4A and 4B, viewing the separation pad holder from an obliquely lower part.

Further, as illustrated in FIGS. 4B and 6, the contact part 48*b* of the holder 48 is located close to the rotary shaft 48*a* when viewed from the axial direction of the rotary shaft 48*a* of the holder 48. By forming the contact part 48*b* in the vicinity of the rotary shaft 48*a*, the contact position of the contact part 48*b* with the leaf spring 50 can be stabilized.

Further, by locating the contact part 48*b* and the flexible deforming part 50*a* such that the line of action E of the pressing force F passes through the center of the rotary shaft 48*a* or passes close by the rotary shaft 48*a*, generation of a moment by the pressing force F around the rotary shaft 48*a* can be eliminated or extremely reduced. Accordingly, a contact pressure (e,g, a separation pressure) of the sheet separation pad 47 and the sheet feed roller 30*a* is uniquely determined by the pressing force F applied by the separation spring 49. Therefore, variation of the separation pressure can be reduced or prevented.

Further, by forming the contact part 48*b* projecting from the lower face of the holder 48, the leading end of the flexible deforming part 50*a* of the leaf spring 50 does not contact the lower face other than the contact part 48*b* directly. By so doing, the variation in a pressing position of the leading end of the flexible deforming part 50*a* due to attaching errors of the leaf spring 50 and the variation in parts can be reduced. Accordingly, side effects such as misfeeding and/or abnormal sound occurring when the separation pressure is too large and misfeeding occurring when the separation pressure is too small can be prevented.

The contact part 48*b* is provided with a given constant length in parallel to a longitudinal direction of the rotary shaft 48*a* of the holder 48. Therefore, the contact part 48*b* and the leading end of the flexible deforming part 50*a* of the leaf spring 50 are in line contact with each other in the longitudinal direction of the rotary shaft 48*a*. By so doing, the contact position of the flexible deforming part 50*a* of the leaf spring 50 is stabilized, and therefore the variation in amount of deformation of the flexible deforming part 50*a* toward the rotary shaft 48*a* can be reduced. Accordingly, the variation in the pressing force F toward the rotary shaft 48*a* can be reduced, the posture of the holder 48 can be more stable, vibration of the holder 48 is more reduced, and vibration and abnormal sound prevention effect can be stabilized.

Further, in the present example of this disclosure, the contact part 48*b* of the holder 48 and the flexible deforming part 50*a* of the leaf spring 50 are disposed laterally symmetric with respect to the cross section at the center in the axial direction (a longitudinal direction) of the rotary shaft 48*a* of the holder 48. By arranging the contact part 48*b* and the flexible deforming part 50*a* laterally symmetric, the pressing force F applied to the holder 48 can be balanced at the right and left, and therefore the rattling prevention effect of the holder 48 and the vibration and abnormal sound prevention effect can be stabilized.

Figure 7B:
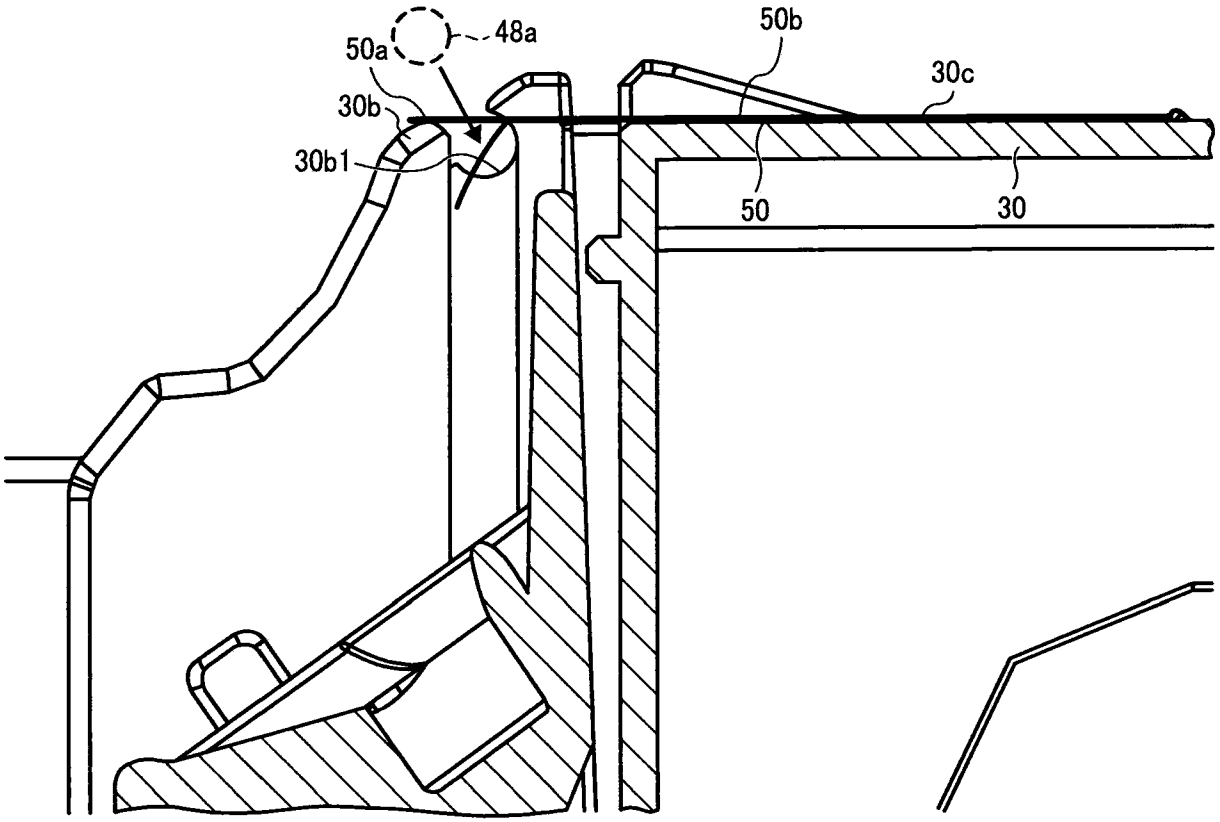
FIG. 7B is a side view illustrating the sheet feeder of FIGS. 4A and 4B from which the sheet feed roller and the separation pad holder are removed.

FIG. 7A is a perspective view illustrating the sheet feeder 600 from which the sheet feed roller 30*a* and the separation pad holder 48 are removed. FIG. 7B is a side view illustrating the sheet feeder 600 from which the separation pad holder 48 are removed.

When the holder 48 is removed from the sheet feeder 600, as illustrated in FIGS. 7A and 7B, the flexible deforming part 50*a* of the leaf spring 50 are restored horizontally. In this state, the flexible deforming part 50*a* is located higher than the retaining parts 30*b* in a direction of attachment of the holder 48.

When the rotary shaft 48*a* of the holder 48 is attached to the retaining parts 30*b* from this state, both ends of the rotary shaft 48*a* are fitted to the respective retaining parts 30*b* while pressing down the flexible deforming part 50*a* with the contact part 48*b* arranged near the rotary shaft 48*a*. Therefore, the holder 48 can be attached in a single operation, and therefore is preferably easy to attach the holder 48.

In the present example of this disclosure, the leaf spring 50 is fixed by an adhesive member such as a double-coated adhesive tape to the attaching part 30*c* of the sheet tray 30. As illustrated in FIG. 4B, a side face A (i.e., the lower face) of the leaf spring 50 on which the double-coated adhesive tape is attached and a side face B (i.e., the upper face) of the leaf spring 50 on which the leaf spring 50 contacts the holder 48 are different faces. Therefore, a direction of elastic deformation of the leaf spring 50 is set opposite to a direction of removal of the double-coated adhesive tape. By so doing, the present example of this disclosure can provide the configuration having the leaf spring 50 is difficult to separate from the attaching part 30*c* of the sheet tray 30.

The leaf spring 50 in the present example is a flexible member that elastically deforms but is not limited thereto. For example, the leaf spring 50 can be selected from any optional materials such as a metallic thin plate and a resin sheet material. Specifically, in order to prevent the change and variation in the separation pressure due to the frictional force between the leaf spring 50 and the contact part 48*b* of the holder 48, a slidable resin material is used as material of the leaf sprig 50, a fluororesin based lubricant is applied on the surface of the leaf spring 50, or the leaf spring 50 is processed to attach a Teflon tape ("Teflon" is registered).

Further, as a variation, a rotation roller is provided to the contact part 48*b* of the holder 48, so that the leading end of the flexible deforming part 50*a* of the leaf spring 50 is attached to the rotation roller. This configuration can effectively prevent the change or variation in the separation pressure due to the frictional force applied to the contact portion between the leading end of the flexible deforming part 50*a* and the contact part 48*b* of the holder 48.

Next, a description is given of results of test conducted to confirm effects to restrain vibration and abnormal sound according to the present example of this disclosure.

Figure 8:
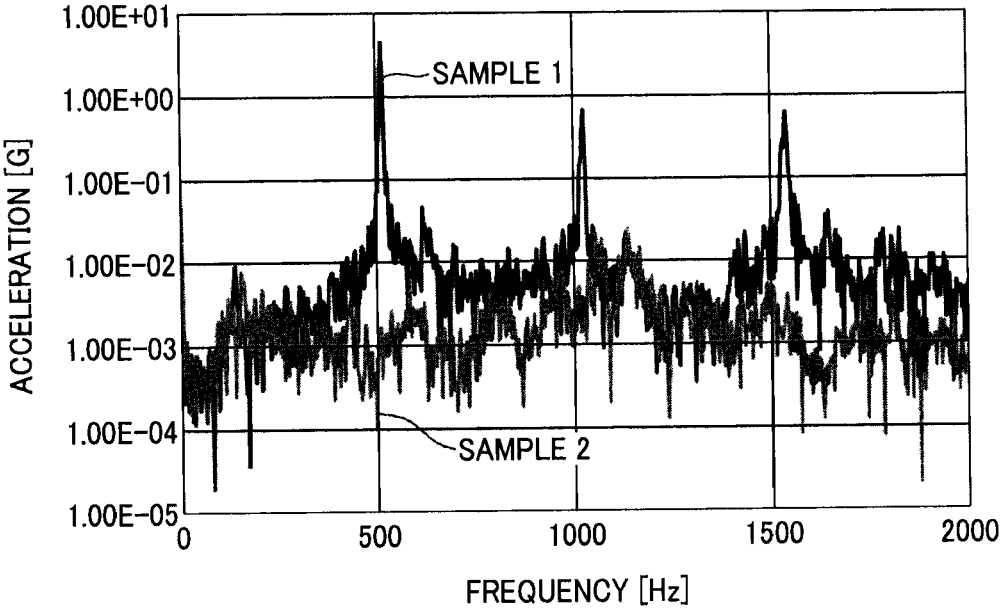
FIG. 8 is a graph showing results of comparison of vibration noise caused by the sheet feeder of FIGS. 4A and 4B and vibration noise caused by a comparative sheet feeder.

The graph of FIG. 8 shows results of test conducted using the sheet feeder 600 according to this example and the comparative sheet feeder on comparison of respective vibration accelerations of the holder 48 obtained by feeding sheets using these sheet feeders. The sheet feeder 600 and the comparative sheet feeder are basically identical in configuration and materials, except that the sheet feeder 600 includes the leaf spring 50 and the contact part 48*b* of the holder 48 while the comparative sheet feeder does not include the leaf spring 50 and the contact part 48*b* of the holder 48.

The waveforms shown in FIG. 8 were results of frequency analysis performed by FFT (Fast Fourier Transform) on vibration generated on the holder 48 when the sheet P is fed by the sheet feed roller 30*a* of the sheet feeder 600 according to this example and by the sheet feed roller of the comparative sheet feeder. In the graph of FIG. 8, a horizontal axis indicates frequency [Hz] and a vertical axis indicates acceleration [G].

The waveform indicated as "Sample 1" by a dark line is the result obtained by tests with the comparative sheet feeder, and the waveform indicated as "Sample 2" by a light line is the result obtained by tests with the sheet feeder 600 according to an example of this disclosure, as illustrated from FIG. 4 through FIG. 7B.

According to the graph of FIG. 8, as the value of acceleration [G] increases, the holder 48 causes large vibration, and therefore greater level of abnormal sound occurs simultaneously. The abnormal sound is caused by the stick-slip vibration of the sheet S to the sheet separation pad 47. Based on the test results, there is a large difference between the configuration of the sheet feeder 600 according to the present example of this disclosure and the configuration of the comparative sheet feeder. Therefore, it was confirmed the configuration of the sheet feeder 600 according to the present example of this disclosure allows not a large but a small vibration to be generated.

According to the test results, compared to the comparative sheet feeder, the sheet feeder 600 according to the present example of this disclosure can significantly reduce vibration generating on the holder 48. The test results have confirmed that the comparative sheet feeder generates a vibration level about 77 times as the vibration level of the sheet feeder 600 according to the example of this disclosure. Accordingly, it was proved that the configuration of the sheet feeder 600 according to the present example of this disclosure is effective to restrain vibration of the holder 48 and restrain and prevents occurrence of abnormal sound.

Figure 9A:
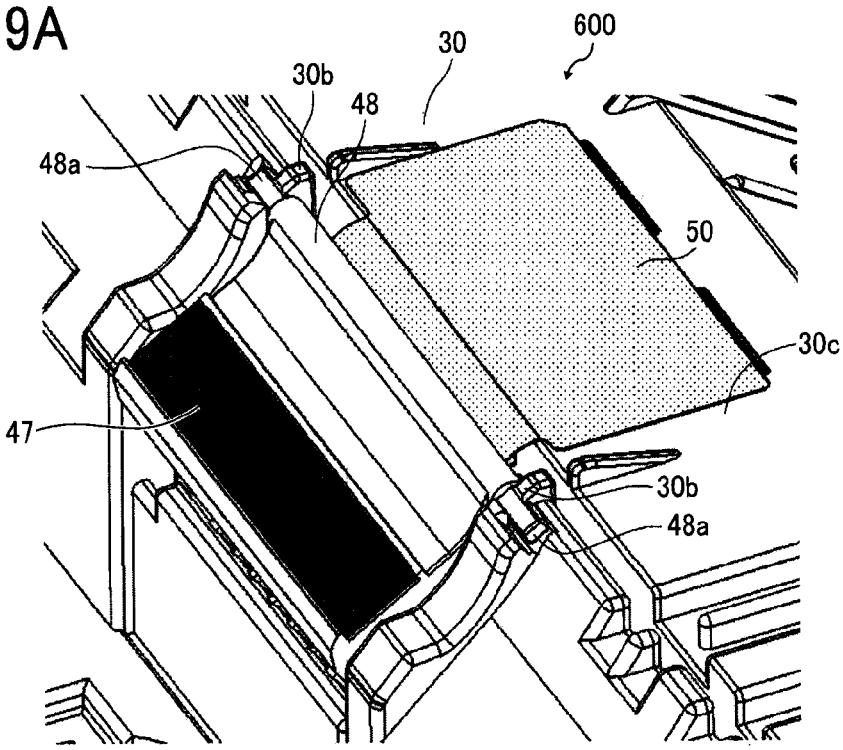
FIG. 9A is a perspective view illustrating the sheet feeder according to another example of this disclosure, from which the sheet feed roller is removed.
Figure 9B:
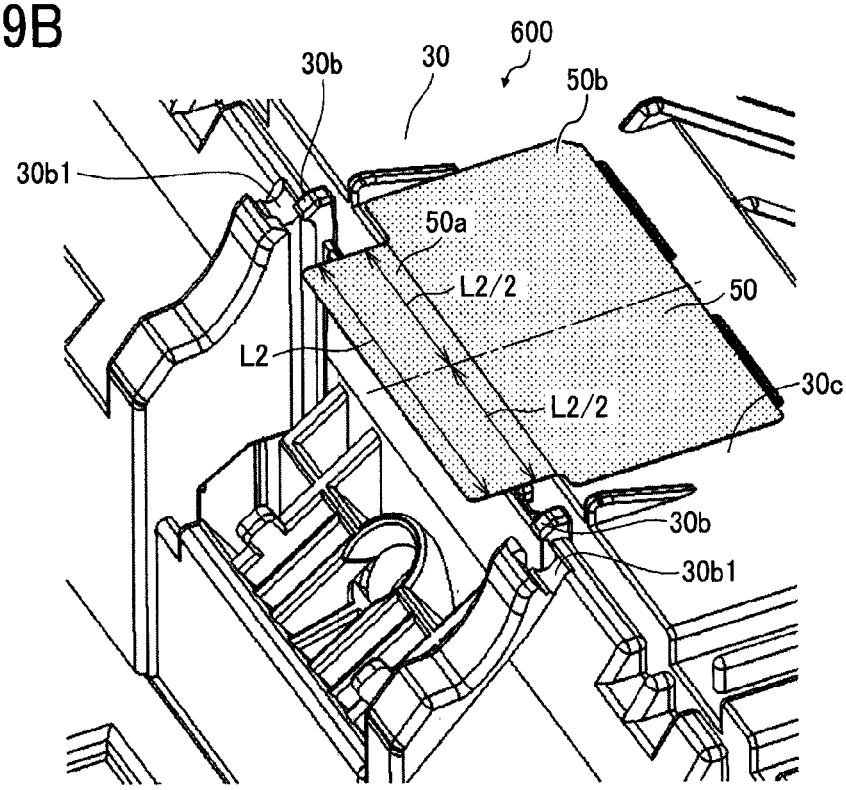
FIG. 9B is a perspective view illustrating the sheet feeder of FIG. 9A, from which the sheet feed roller and the separation pad holder are removed.

Next, a description is given of a configuration of the sheet feeder 600 according to another example of this disclosure, with reference to FIGS. 9A and 9B.

FIG. 9A is a perspective view illustrating the sheet feeder 600 having the sheet separation pad 47 and the holder 48. FIG. 9B is a perspective view illustrating the sheet feeder 600 of FIG. 9A, from which the holder 48 is removed.

The basic configuration of the sheet feeder 600 according to the present example is basically identical to the configuration of the sheet feeder 600 according to the example illustrated in FIGS. 4A through 8. Specifically, the sheet feeder 600 includes the sheet feed roller 30*a* to feed the sheet P as illustrated in FIGS. 2A and 2B, the sheet separation pad 47 to separate the sheet P one by one from the bundle of sheets, the holder 48 to support the sheet separation pad 47, the separation spring 49 and the leaf spring 50 to press the holder 48 to the sheet feed roller 30*a*.

It is to be noted that a width indicated with "L2/2" in FIG. 9B is a half of the length of the width L2.

The flexible deforming part 50*a* of the leaf spring 50 according to the present example of this disclosure has a width L2 that is substantially twice longer than the width L1 according to the example according to FIGS. 4A through 8. By increasing the width of the flexible deforming part 50*a* from the width L1 to the width L2, the pressing force F of the holder 48 can be increased. By contrast, when the width of the flexible deforming part 50*a* is reduced, the pressing force F of the holder 48 can also be reduced.

Thus, when the configuration includes the leaf spring 50, the pressing force F of the holder 48 can be adjusted (increased or reduced) easily depending on increase and reduction of the width of the flexible deforming part 50*a*. Therefore, even if the tendency of occurrence of abnormal sound differs due to various configurations of the sheet feeder 600, the pressing force F of the holder 48 can be adjusted without changing the configuration significantly.

Figure 10A:
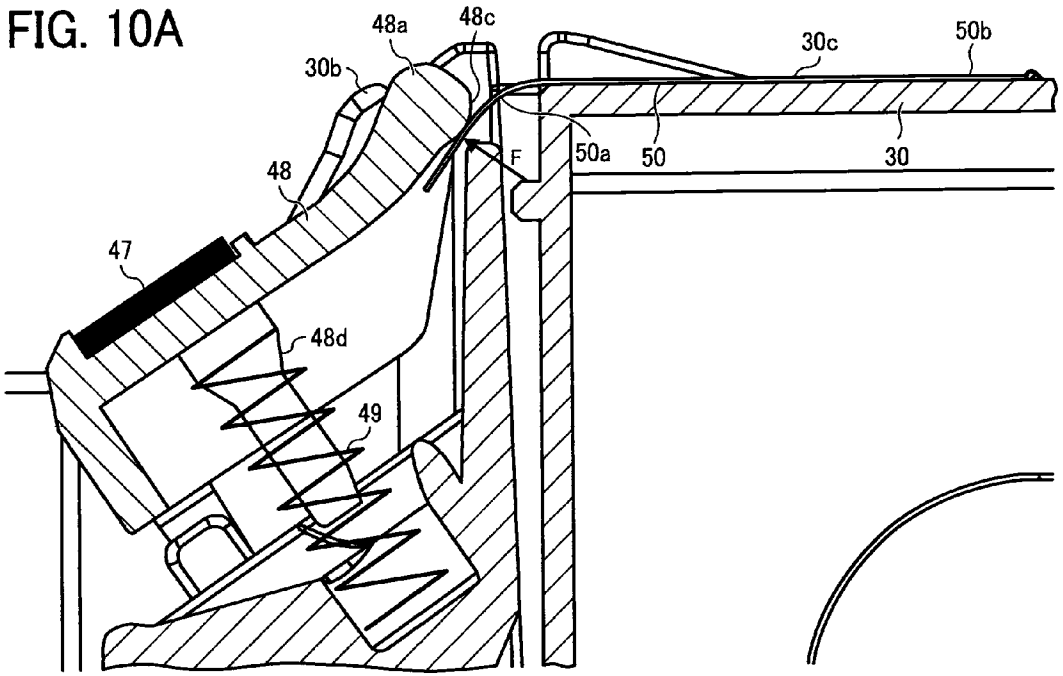
FIG. 10A is a cross sectional view illustrating the sheet feeder of FIGS. 9A and 9B at the center in a width direction of the separation pad holder.
Figure 10B:
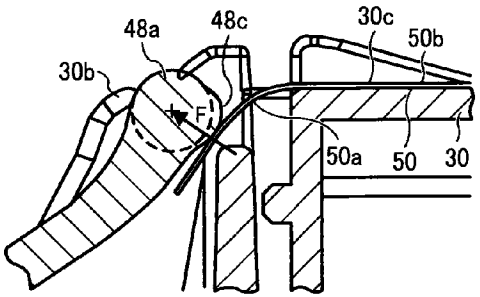
FIG. 10B is an enlarged side view illustrating the rotary shaft of the separation pad holder of the sheet feeder of FIGS. 9A and 9B.

FIG. 10A is a cross sectional view illustrating the sheet feeder 600 of FIGS. 9A and 9B at the center in the width direction of the holder 48. FIG. 10B is an enlarged side view illustrating the area close to the rotary shaft 48*a* of the holder 48 of the sheet feeder 600 of FIGS. 9A and 9B.

In the present example, the holder 48 further includes an arc-shaped contact part 48*c* that rotates about the rotary shaft 48*a*. By forming the contact part 48*c* in an arc shape, a vector of the pressing force F that is received by the contact part 48*c* from the leaf strings 50 is directed to the center of the rotary shaft 48*a*, as illustrated in FIG. 10B. Therefore, a moment that is received by the holder 48 based on the pressing force F becomes zero theoretically, and vibration and abnormal sound prevention effect can be stabilized.

Accordingly, variation in the separation pressure due to the pressing force F by the leaf spring 50 can be prevented. Accordingly, side effects such as misfeeding and/or abnormal sound occurring when the separation pressure is too large and misfeeding occurring when the separation pressure is too small can be prevented, and the abnormal sound prevention effect can be obtained.

Figure 11:
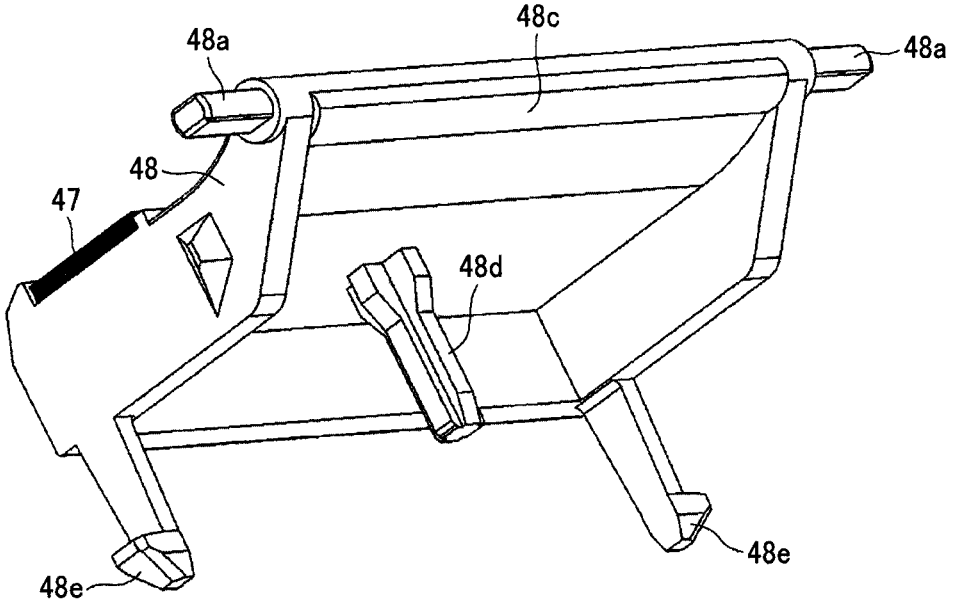
FIG. 11 is a perspective view illustrating the sheet feeder of FIGS. 9A and 9B, viewing the separation pad holder from an obliquely lower part.

Further, as illustrated in FIG. 11, the contact part 48*c* of the holder 48 is provided over the entire width of the holder 48. By so doing, the width of the flexible deforming part 50*a* of the leaf spring 50 can be occasionally adjusted in the holder 48 having the identical configuration.

Figure 12A:
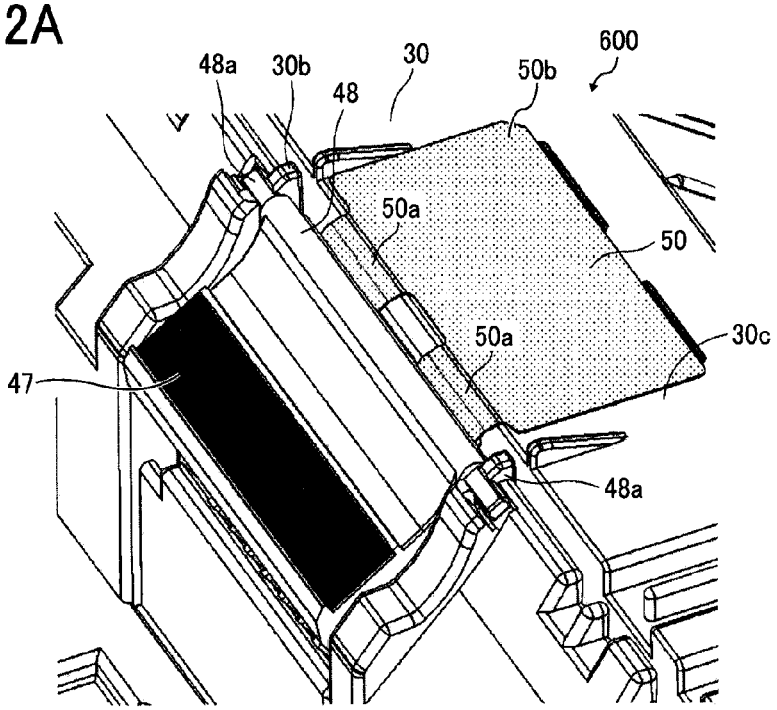
FIG. 12A is a perspective view illustrating the sheet feeder according to yet another example of this disclosure, from which the sheet feed roller is removed.
Figure 12B:
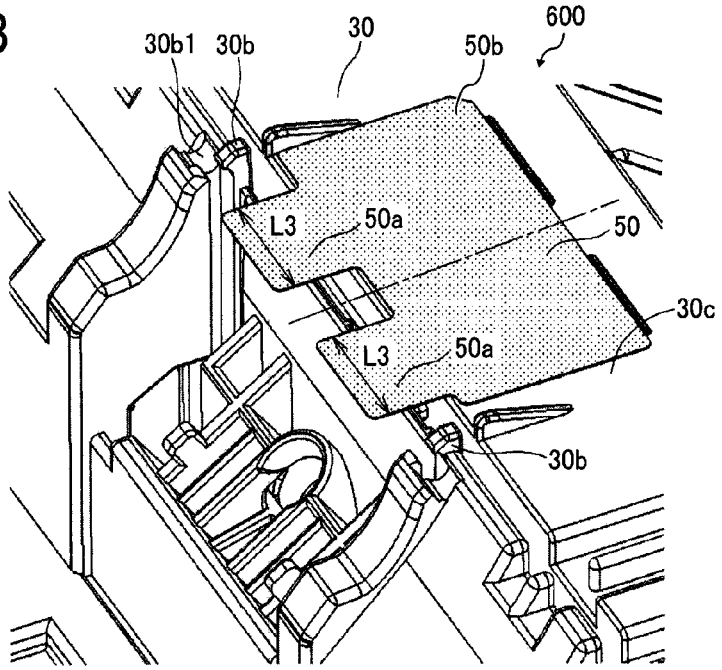
FIG. 12B is a perspective view illustrating the sheet feeder of FIG. 12A, from which the sheet feed roller and the separation pad holder are removed.

FIG. 12A is a perspective view illustrating the sheet feeder 600 according to yet another example of this disclosure. FIG. 12B is a perspective view illustrating the sheet feeder 600 of FIG. 12A.

In the present example of this disclosure, the flexible deforming parts 50*a* of the leaf springs 50 are disposed laterally symmetric as a pair of right and left members with respect to the cross section at the center in the longitudinal direction of the rotary shaft 48*a*.

In the configuration in which the single flexible deforming part 50*a* is disposed symmetric with respect to the center in the width direction thereof, as illustrated in FIGS. 4A, 4B, 7A, and 7B, the width of the flexible deforming part 50*a* becomes narrower so as to reduce the pressing force F of the flexible deforming part 50*a*. However, if the width of the flexible deforming part 50*a* is narrower, the flexible deforming part 50*a* of the leaf spring 50 in a relatively narrow area at or close to the center of the contact part 48*b* of the holder 48 in the width direction of the contact part 48*b*, and therefore the holder 48 may not be balanced well in the horizontal direction.

In order to address the above-described inconvenience, the configuration in the present example of this disclosure has a pair of flexible deforming parts 50*a* of the leaf spring 50 arranged laterally symmetric with respective to the center in the width direction thereof, as illustrated in FIGS. 12A and 12B.

By reducing respective widths L3 of the laterally symmetric pair of flexible deforming parts 50*a*, the pressing force F generated by the flexible deforming part 50*a* can be reduced while balancing the right and left of the holder 48. The two flexible deforming parts 50*a* contact an area of the rotary shaft 48*a* extremely close to the retaining parts 30*b*. By so doing, the right and left of the holder 48 can be further balanced.

Figure 13A:
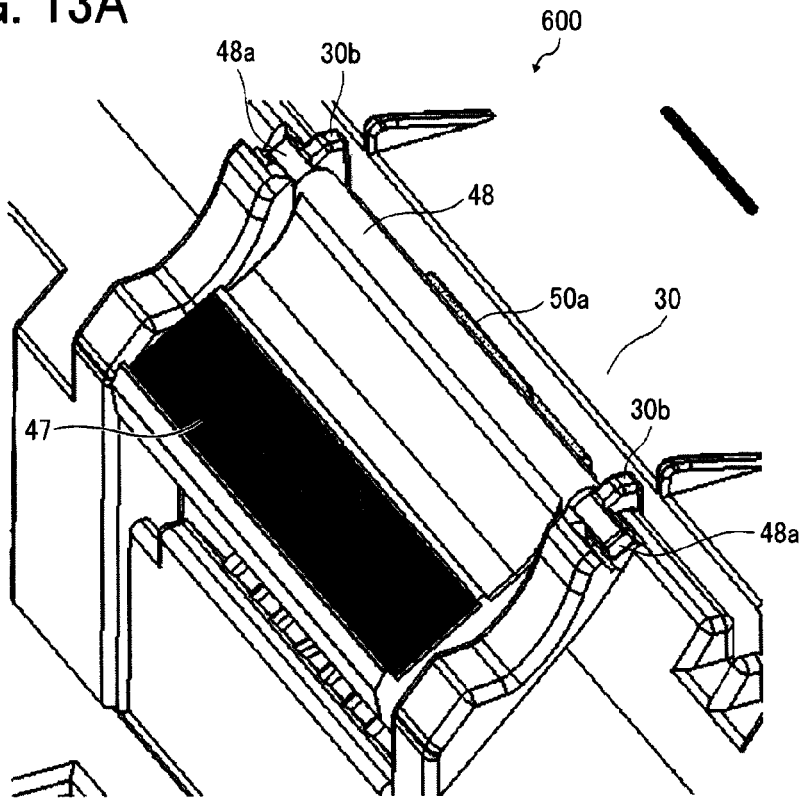
FIG. 13A is a perspective view illustrating the sheet feeder according to yet another example of this disclosure, from which the sheet feed roller is removed.
Figure 13B:
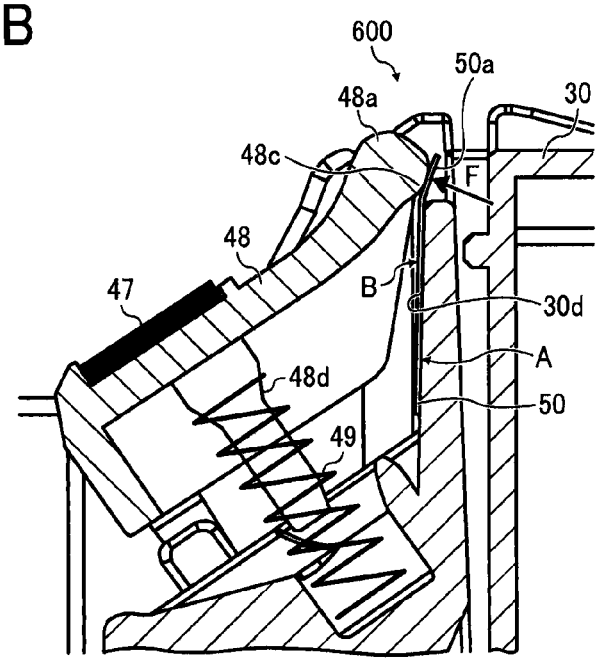
FIG. 13B is a cross sectional view illustrating the sheet feeder of FIG. 13A at the center in a width direction of the separation pad holder.

FIG. 13A is a perspective view illustrating the sheet feeder 600 according to yet another example of this disclosure. FIG. 13B is a cross sectional view illustrating the sheet feeder 600 of FIG. 13A.

As illustrated in FIGS. 13A and 13B, the configuration according to the present example of this disclosure includes the leaf spring 50 at a position different from the configuration illustrated in FIGS. 12A and 12B. Specifically, the sheet tray 30 according to the present example of this disclosure includes an attaching part 30*d*. The attaching part 30*d* is part of a vertical wall (a side face of the sheet tray 30) of the sheet tray 30 located below the holder 48. The leaf spring 50 is attached to the attaching part 30*d*.

By forming the attaching part 30*d* at the position, the space for installing the leaf spring 50 is reduced, the degree of freedom in designing the sheet feeder 600, and the direction of pressure of the pressing force F can be changed easily.

Thus, even if the position of the leaf spring 50 is changed, the effect of pressing the area close to the rotary shaft 48*a* of the holder 48 can be achieved, which is similar to the previously described examples of this disclosure.

Further, the attaching part 30*d* is directed toward an upstream side in the sheet conveying direction of the sheet feeder 600. The flexible deforming part 50*a* of the leaf spring 50 projects upwardly by a small amount from the attaching part 30*d*, and the leading end of the flexible deforming part 50*a* contacts in the area close to the rotary shaft 48*a* from a downstream side in the sheet conveying direction when viewed in the axial direction of the rotary shaft 48*a*.

In the present example of this disclosure, by forming the side face A (a right side face) of the leaf spring 50 on which the double-coated adhesive tape is attached and the side face B (a left side face) of the leaf spring 50 on which the leaf spring 50 to different faces, a direction of elastic deformation of the leaf spring 50 is set opposite to a direction of removal of the double-coated adhesive tape. Accordingly, the configuration has the leaf spring 50 that cannot easily separate from the attaching part 30*c*.

Figure 14A:
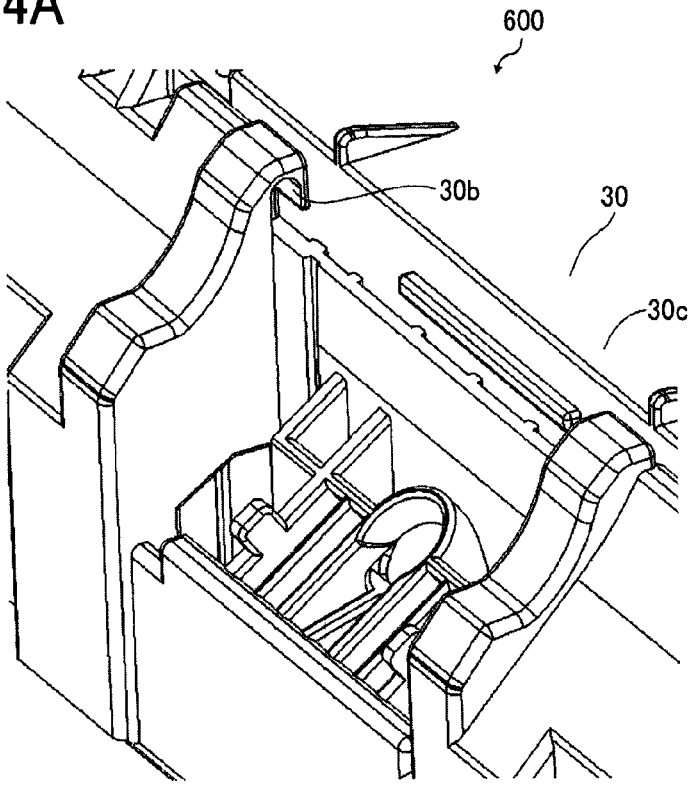
FIG. 14A is a perspective view illustrating the sheet feeder according to yet another example of this disclosure, from which the sheet feed roller and the separation pad holder are removed.
Figure 14B:
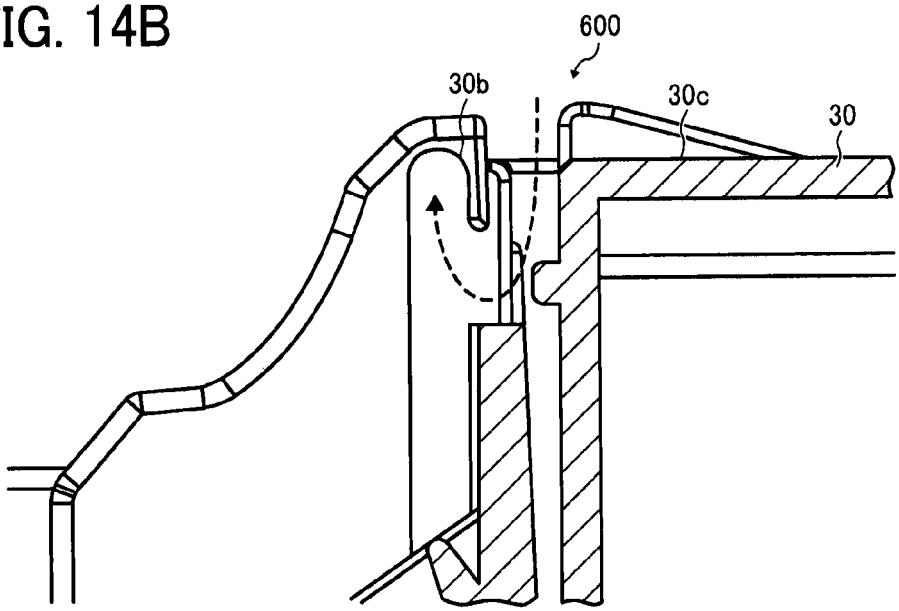
FIG. 14B is a side view illustrating the sheet feeder of FIG. 14A from which the sheet feed roller and the separation pad holder are removed.

FIG. 14A is a perspective view illustrating the sheet feeder 600 according to yet another example of this disclosure, showing the retaining parts 30*b* that supports the holder 48. FIG. 14B is a side view illustrating the sheet feeder 600.

As illustrated in FIG. 14B, the retaining parts 30*b* includes an inverted U-shaped gutter that functions as a downward and inverted U shape member. The rotary shaft 48*a* of the holder 48 is set to the inverted U-shaped gutter from below in the path indicated by a dotted line in FIG. 14B.

As previously described, it is preferable to fit the rotary shaft 48*a* by snap-fit to the retaining part 30*b* from above. However, in the present example of this disclosure, the rotary shaft 48*a* is set from below and the leaf spring 50 can support the rotary shaft 48*a*. Therefore, the configuration according to the present example may not need to employ fitting by the snap-fit.

Figure 15:
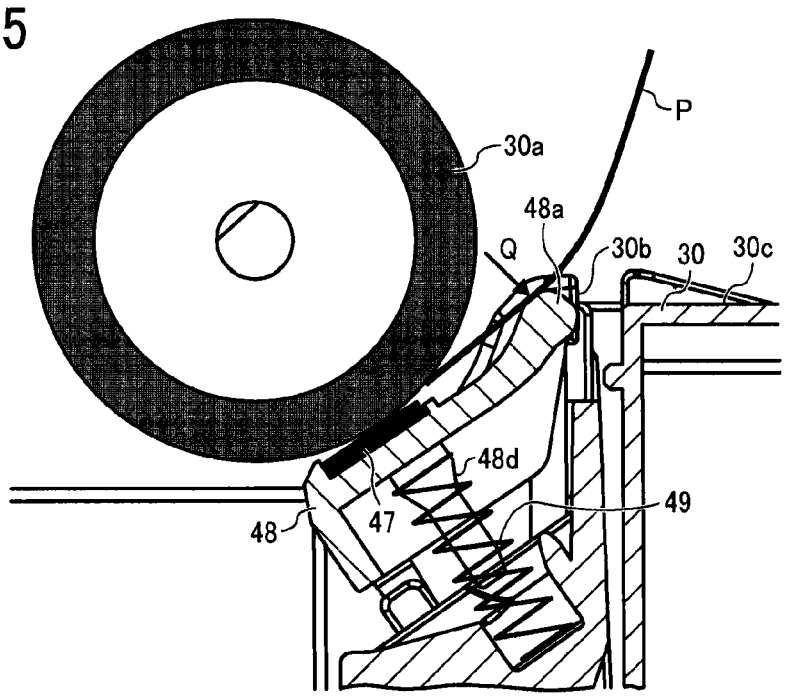
FIG. 15 is a cross sectional view illustrating the sheet feeder of FIGS. 14A and 14B at the center in a width direction of the separation pad holder (in a state in which the separation pad holder is pressed down due to rigidity of the sheet)
Figure 16:
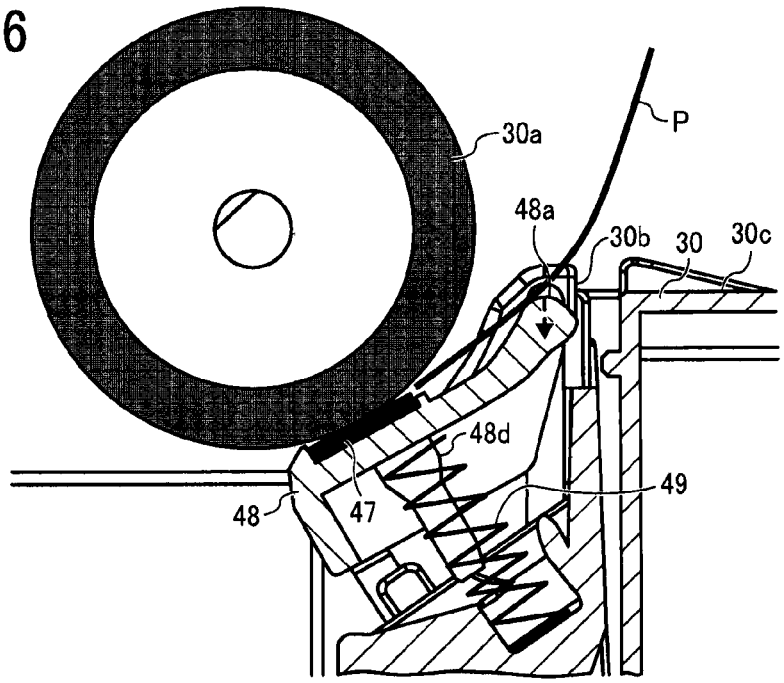
FIG. 16 is a cross sectional view illustrating the sheet feeder of FIGS. 14A and 14B at the center in the width direction of the separation pad holder (in a state in which the separation pad holder is not pressed by a leaf spring)

In a case in which the configuration of the present example does not employ the leaf spring 50, when a force Q to press down the rotary shaft 48*a* of the holder 48 is exerted due to rigidity of the sheet P while being conveyed as illustrated in FIG. 15, the rotary shaft 48*a* is pressed down in a direction indicated by arrow illustrated in FIG. 16 (i.e., in a downward direction) by responding to the force Q. Due to this action, the angle of position of the holder 48, i.e., the angle of position of the sheet separation pad 47 is changed. Consequently, the separation performance can be adversely affected when the subsequent sheet P is conveyed.

Figure 17:
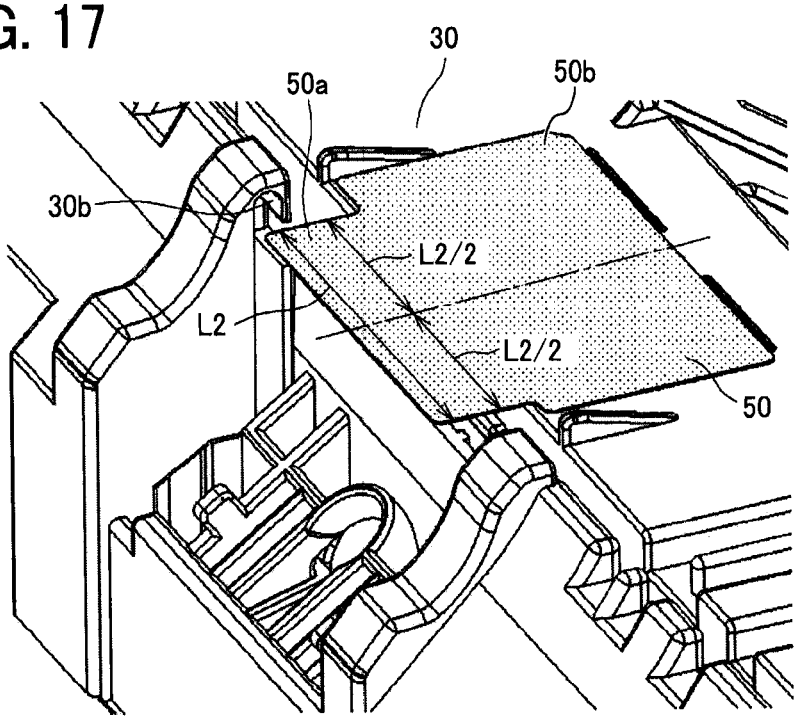
FIG. 17 is a perspective view illustrating the sheet feeder of FIGS. 14A and 14B from which the sheet feed roller and the separation pad holder are removed.
Figure 18:
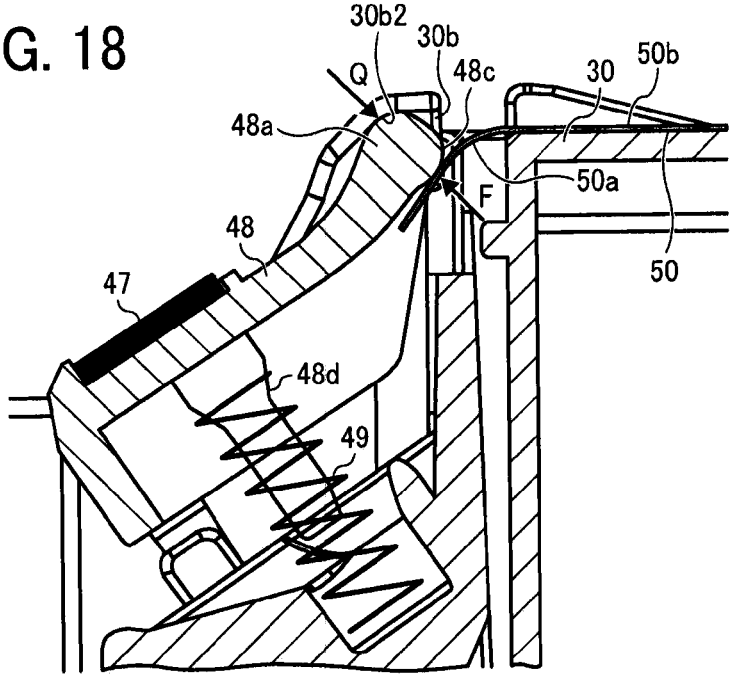
FIG. 18 is a cross sectional view illustrating the sheet feeder of FIG. 14A at the center in a width direction of the separation pad holder (in a state in which the separation pad holder is pressed by the leaf spring).

However, by providing the leaf spring 50 to the configuration of the present example, a "push-down" of the holder 48 can be prevented. Specifically, by providing the leaf spring 50 as illustrated in FIG. 17, which is same as the above-described examples of this disclosure, the pressing force F can be directed to a direction where the rotary shaft 48*a* is not pressed down, as illustrated in FIG. 18. By so doing, the "push-down" of the holder 48 generated by rigidity of the sheet P while being conveyed can be prevented.

Further, even if the push-down of the holder 48 by the sheet P during conveyance does not occur, by pressing the rotary shaft 48*a* to a ceiling 30*b*2 of a U-shaped gutter of the retaining parts 30*b*, the position of the rotary shaft 48*a* can be retained with accuracy, and sheet feed and separation performance as designed can be obtained easily. Accordingly, in the sheet feeder 600 including the retaining parts 30*b* of the holder 48 according to the present example of this disclosure, both abnormal sound prevention effect and stabilization of sheet feed and separation can be achieved simultaneously.

As described above, the sheet feeder 600 according to the above-described examples of this disclosure are described. Although the above-described examples have been described herein, it will be apparent that this disclosure is not limited thereto and that many modifications and additions thereto may be made within the scope of disclosure contained in the description and claims. For example, any sheet feeding body or sheet feeding member used in the sheet feeder 600 according to any example of this disclosure can be applied as long as the sheet feeding body or the sheet feeding member feeds a sheet in a given sheet conveying direction. Therefore, the sheet feed roller 30*a* can be replaced to a sheet feed belt or other sheet feed members.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A sheet feeder of a friction pad separation type comprising:

a feeder body;

a rotary feed body in contact with a first side of a recording medium in the feeder body and rotating and feeding the recording medium to a downstream side along a sheet conveying direction;

a separation body in contact with a second side of the recording medium and fixed to the feeder body while facing the rotary feed body, the separation body separating the recording medium with the rotary feed body;

a holder having a rotary shaft at an end thereof and holding the separation body while being rotatably supported by the rotary shaft; and a leaf spring attached to the feeder body and having a flexible deforming part formed on one end thereof, the flexible deforming part configured to contact the holder in an area adjacent to the rotary shaft in an axial direction of the rotary shaft and a line of action of a pressing force of the flexible deforming part passing near the rotary shaft.

2. The sheet feeder according to claim 1, wherein the leaf spring has a body and an entire part of the body except the flexible deforming part is fixedly adhered to an attaching part formed on an upper face of the feeder body, and wherein the flexible deforming part of the leaf spring contacts close to the rotary shaft from below when viewed from the axial direction of the rotary shaft.

3. The sheet feeder according to claim 2, wherein the entire part of the body except the flexible deforming part is further fixedly adhered to an attaching part formed on a side face of the feeder body facing an upstream side in the sheet conveying direction, and wherein the flexible deforming part of the leaf spring contacts close to the rotary shaft from a downstream side in the sheet conveying direction when viewed from the axial direction of the rotary shaft.

4. The sheet feeder according to claim 2, wherein the holder further includes a contact part formed close to the rotary shaft in an outwardly curved shape when viewed from the axial direction of the rotary shaft, and wherein the flexible deforming part of the leaf spring contacts the contact part near the rotary shaft.

5. The sheet feeder according to claim 2, wherein the holder further includes a contact part formed close to the rotary shaft in an arc shape about the rotary shaft when viewed from the axial direction of the rotary shaft, and wherein the flexible deforming part of the leaf spring contacts the contact part near the rotary shaft.

6. The sheet feeder according to claim 2, wherein the holder further includes a contact part formed close to the rotary shaft in parallel to a longitudinal direction of the rotary shaft, and wherein the flexible deforming part of the leaf spring is in line contact with the contact part.

7. The sheet feeder according to claim 2, wherein the feeder body includes a retaining part having a shaft hole in a form of a downward U shape, wherein both ends of the rotary shaft are engaged with the retaining part of the feeder body, and wherein both ends of the rotary shaft contact a ceiling formed on the retaining part.

8. An image forming apparatus comprising:

an image bearer configured to form an electrostatic latent image on a surface thereof;

a charger configured to uniformly charge the surface of the image bearer;

an exposure device configured to write the electrostatic latent image on the surface of the image bearer according to image data;

a developing device provided with a developer bearer configured to bear developer including toner thereon and developing the electrostatic latent image formed on the surface of the image bearer into a visible image by supplying the developer borne on the developer bearer;

a transfer device configured to transfer the visible toner image developed by the developing device onto the recording medium; and the sheet feeder according to claim 2 to feed the recording medium to the transfer device.

9. The sheet feeder according to claim 1, wherein the leaf spring has a body and an entire part of the body except the flexible deforming part is fixedly adhered to an attaching part formed on a side face of the feeder body facing an upstream side in the sheet conveying direction, and wherein the flexible deforming part of the leaf spring contacts close to the rotary shaft from a downstream side in the sheet conveying direction when viewed from the axial direction of the rotary shaft.

10. The sheet feeder according to claim 9, wherein the holder further includes a contact part formed close to the rotary shaft in an outwardly curved shape when viewed from the axial direction of the rotary shaft, and wherein the flexible deforming part of the leaf spring contacts the contact part near the rotary shaft.

11. The sheet feeder according to claim 9, wherein the contact part is formed in an arc shape about the rotary shaft when viewed from the axial direction of the rotary shaft, and wherein the flexible deforming part of the leaf spring contacts the contact part near the rotary shaft.

12. The sheet feeder according to claim 9, wherein the contact part is formed in parallel to a longitudinal direction of the rotary shaft, and wherein the flexible deforming part of the leaf spring is in line contact with the contact part.

13. The sheet feeder according to claim 1, wherein the holder further includes a contact part formed close to the rotary shaft in an outwardly curved shape when viewed from the axial direction of the rotary shaft, and wherein the flexible deforming part of the leaf spring contacts the contact part near the rotary shaft.

14. The sheet feeder according to claim 13, wherein the contact part is formed in an arc shape about the rotary shaft when viewed from the axial direction of the rotary shaft, and wherein the flexible deforming part of the leaf spring contacts the contact part near the rotary shaft.

15. The sheet feeder according to claim 1, wherein the holder further includes a contact part formed close to the rotary shaft in an arc shape about the rotary shaft when viewed from the axial direction of the rotary shaft, and wherein the flexible deforming part of the leaf spring contacts the contact part near the rotary shaft.

16. The sheet feeder according to claim 1, wherein the holder further includes a contact part formed close to the rotary shaft in parallel to a longitudinal direction of the rotary shaft, and wherein the flexible deforming part of the leaf spring is in line contact with the contact part.

17. The sheet feeder according to claim 6, wherein the flexible deforming part of the leaf spring is disposed laterally symmetric with respect to a cross section in a longitudinal direction of the rotary shaft.

18. The sheet feeder according to claim 7, wherein the flexible deforming part of the leaf spring is a pair of flexible deforming parts disposed laterally symmetric with respect to a cross section at a center in a longitudinal direction of the rotary shaft.

19. The sheet feeder according to claim 1, wherein the feeder body includes a retaining part having a shaft hole in a form of a downward U shape, wherein both ends of the rotary shaft are engaged with the retaining part of the feeder body, and wherein both ends of the rotary shaft contact a ceiling formed on the retaining part.

20. An image forming apparatus comprising:

an image bearer to form an electrostatic latent image on a surface thereof;

a charger configured to uniformly charge the surface of the image bearer;

an exposure device configured to write the electrostatic latent image on the surface of the image bearer according to image data;

a developing device provided with a developer bearer configured to bear developer including toner thereon and developing the electrostatic latent image formed on the surface of the image bearer into a visible image by supplying the developer borne on the developer bearer;

a transfer device configured to transfer the visible toner image developed by the developing device onto the recording medium; and the sheet feeder according to claim 1 to feed the recording medium to the transfer device.

* * * * *